US008237718B2

(12) United States Patent
Lum et al.

(10) Patent No.: US 8,237,718 B2
(45) **Date of Patent: *Aug. 7, 2012**

(54) APPARATUS AND METHODS TO ACHIEVE A VARIABLE COLOR PIXEL BORDER ON A NEGATIVE MODE SCREEN WITH A PASSIVE MATRIX DRIVE

(75) Inventors: David W. Lum, Pleasanton, CA (US); Yichang Chan, Fremont, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/787,315

(22) Filed: May 25, 2010

(65) Prior Publication Data

US 2011/0316867 A1 Dec. 29, 2011

Related U.S. Application Data

(63) Continuation of application No. 10/980,133, filed on Nov. 1, 2004, now Pat. No. 7,724,270, which is a continuation of application No. 10/087,369, filed on Feb. 28, 2002, now Pat. No. 6,831,662, which is a continuation-in-part of application No. 09/818,081, filed on Mar. 26, 2001, now Pat. No. 7,425,970, which is a continuation-in-part of application No. 09/709,142, filed on Nov. 8, 2000, now Pat. No. 6,961,029.

(51) Int. Cl.
*G09G 5/24* (2006.01)
*G09G 3/36* (2006.01)

(52) U.S. Cl. ..... 345/469.1; 345/100

(58) Field of Classification Search ..... 345/698, 345/100, 469.1, 519, 502
See application file for complete search history.

(56) References Cited

U.S. PATENT DOCUMENTS 6,154,225 A * 11/2000 Kou et al. ..... 345/519
6,288,704 B1 * 9/2001 Flack et al. ..... 345/158

FOREIGN PATENT DOCUMENTS

FR EP 0 394 814 A1 * 4/1990

* cited by examiner

*Primary Examiner* — Kevin M Nguyen

(57) ABSTRACT

A display unit is constituted by a passive matrix of independently controllable pixels characterized by an active area of n rows and m columns of discrete pixels and a pixel border. The pixel border has a predetermined width, in one embodiment two pixels. The border pixel color state is controlled herein by the frame buffer memory. The pixel border color state is controlled to correspond to information contained in a frame buffer memory locus. This locus may be, in various embodiments herein, a single pixel, a row of pixels, or a number of rows of pixels of frame buffer memory. Each row of pixels may be equal to m and/or n. In one embodiment, the frame buffer controls the border pixels directly via a liquid crystal display controller and drivers, without a timing generation mechanism, such as a timing ASIC.

24 Claims, 29 Drawing Sheets

APPARATUS AND METHODS TO ACHIEVE A VARIABLE COLOR PIXEL BORDER ON A NEGATIVE MODE SCREEN WITH A PASSIVE MATRIX DRIVE

RELATED U.S. APPLICATION

The present application is a continuation application of U.S. application Ser. No. 10/980,133, now U.S. Pat. No. 7,724,270, by David Lum and Yichang Chang, filed Nov. 1, 2004, which is hereby incorporated by reference and which itself is a continuation of U.S. application Ser. No. 10/087,369, now U.S. Pat. No. 6,831,662, by David Lum and Yichang Chang, filed Feb. 28, 2002, which is hereby incorporated by reference and which itself is a continuation-in-part application of U.S. application Ser. No. 09/818,081, now U.S. Pat. No. 7,425,970, by Shawn Gettemy, Sherridythe Fraser, and David Lum, filed Mar. 26, 2001 and which is hereby incorporated by reference, and which itself is a continuation-in-part of U.S. application Ser. No. 09/709,142, now U.S. Pat. No. 6,961,029, by Canova, et al., filed Nov. 8, 2000 and which is also hereby incorporated by reference. The incorporated referenced applications are assigned to the assignee of the present invention.

BACKGROUND OF THE INVENTION

1. Field of the Invention

The present invention relates to the field of display screen technology. More specifically, embodiments of the present invention relate to flat panel display screens that are useful in conjunction with portable electronic devices.

2. Related Art

As the components required to build a computer system have reduced in size, new categories of computer systems have emerged. One of the new categories of computer systems is the "palmtop" computer system. A palmtop computer system is a computer that is small enough to be held in the hand of a user and can therefore be "palm-sized." Most palmtop computer systems are used to implement various Personal Information Management (PIM) applications such as an address book, a daily organizer and electronic notepads, to name a few. Palmtop computers with PIM software have been know as Personal Digital Assistants (PDAs). Many PDAs have a small flat display screen associated therewith.

In addition to PDAs, small flat display screens have also been implemented within other portable electronic devices; such as cell phones, electronic pagers, remote control devices and other wireless portable devices.

Liquid crystal display (LCD) technology, as well as other flat panel display technologies, have been used to implement many of the small flat display screens used in portable electronic devices. These display screens contain a matrix of pixels, with each pixel containing subpixels for color displays. Some of the displays, e.g., color displays, use a back lighting element for projecting light through an LCD matrix. Other displays, e.g., black and white, use light reflectivity to create images through the LCD matrix and these displays do not need back lighting elements when used in lit surroundings. Whether color or in black and white, because the displays used in portable electronic devices are relatively small in area, every pixel is typically needed and used by the operating system in order to create displays and present information to the user. Additionally, because the display device is typically integrated together with the other elements of the portable electronic device, the operating systems of the portable electronic devices typically expect the display unit to have a standard pixel dimension, e.g., a standard array of (m×n) pixels is expected.

FIG. 1A illustrates a typical black and white display screen having a standard size pixel matrix 20 with an exemplary edge-displayed character thereon. The edge-displayed character is the letter "A" and is displayed at the left hand side of the display screen at an arbitrary height. The technology could be either transmissive, transflective or reflective passive matrix display, e.g., liquid crystal display (LCD). In a conventional black and white display screen, the background pixels 26 can be light, e.g., not very dark, and the pixels 24 that make up the edge-displayed character can be dark. Importantly, in a positive mode display LCD, unless driven on, the pixels are white. Therefore, the edge location 28 of the display screen, e.g., between the edge of the matrix 20 and the bezel 22 of the portable electronic device, is typically white. As a result, the left edge of the edge-displayed character, "A," has good contrast and is therefore easily viewed by the user. This is the case regardless of the particular edge used, e.g., left, right, top, bottom, because region 28 surrounds the matrix 20.

FIG. 1B illustrates a typical display screen having a pixel matrix 20' with the same edge-displayed character thereon but using negative mode display LCD technology. In negative mode display LCD, unless driven on, the pixels are black. The edge-displayed character is the letter "A" and is displayed at the left hand side of the display screen at an arbitrary height. In this format, the background pixels 26 can still be light and the pixels 24 that make up the edge-displayed character can still be dark. However, importantly, the edge location 28 of the display screen, e.g., between the edge of the matrix 20' and the bezel 22 of the portable electronic device, is typically dark in negative mode display LCD. Being dark, the edge region 28 is the same or similar color as the pixels 24 that make up the character. Therefore, the left edge of the edge-displayed character, "A," has very poor contrast and is therefore typically lost as illustrated in FIG. 1B. This makes reading the edge displayed character very difficult for a user. This is the case regardless of the particular edge used, e.g., left, right, top, bottom, because region 28 surrounds the matrix 20'.

In an attempt to address this problem, some computer systems do not display edge-located characters to avoid the contrast problems associated with the screen edge. Many desktop computer systems, for example, simply try to avoid the display of edge-located characters on the cathode ray tube (CRT) screen or on a late flat panel display. However, this solution is not acceptable in the case of a small display screen where every pixel is needed for image and information presentation. What is needed is a display that makes maximal use of the available screen pixels while eliminating the problems associated with edge displayed characters in a display format where the pixels of the character are of the same or similar color as the edge region 28. What is also needed is a solution that is also compatible with standard display screen dimensions, formats and driver circuitry. Further, what is needed is a solution that controls the color of border pixels, yet simplifies the design and lowers the cost of displays by reducing and/or eliminating the dependency of border pixel control on separate timing components.

SUMMARY OF THE INVENTION

Accordingly, embodiments of the present invention provide an electronic device, e.g., a cell phone, portable computer system, PDA, electronic pager, etc., having a screen that makes maximal use of the available screen pixels while eliminating the problems associated with edge displayed characters in display formats where the pixels of the character are of the same or similar color as the edge region. Embodiments of the present invention are particularly useful in negative mode passive matrix LCD displays that utilize a brighter background and a darker foreground. Embodiments provide the above benefits while being compatible with standard display screen dimensions, formats and driver circuitry. Embodiments of the present invention therefore provide a small display screen with improved viewability, especially at the edge locations. Further, embodiments provide a solution that controls the color of border pixels, yet simplifies the design and lowers the cost of displays by reducing and/or eliminating the dependency of border pixel control on separate timing components. The present invention provides these advantages and others not specifically mentioned above but described in the sections to follow.

A display device is described herein having a display matrix including a pixel border of width x and located around the edge locations of the matrix for improved viewability. In particular, the border region can be several pixels wide, e.g., $1<x<5$. In one embodiment, the border region is two pixels wide and surrounds a display region in which images are generated from a frame buffer memory. In one implementation, both the border region and the display region are implemented using a negative display mode passive display matrix using supertwisted nematic liquid crystal display (LCD) technology. Other passive matrix techniques could also be used in addition to LCD technology, such as, electronic paper, electronic ink, or microelectromechanical machine systems (MEMS), etc.

In one embodiment, the pixels of the border region are controllable between an on state and an off state and have an adjustable threshold voltage level. The threshold voltage level can originate from a gray scale bias circuit which can be controlled by a contrast adjustment. This allows the border brightness and the background brightness to be matched in response to contrast adjustments. In one embodiment, the display screen is a negative mode display in which the pixels are normally black when off. The pixel border is useful in providing contrast in display modes having a white background with black characters displayed therein. In these display modes, the border region is uniformly turned on to provide a white border. As discussed above, the white border adjusts with the background brightness in response to contrast adjustments. The present invention can be applied in either monochrome or color displays. The pixel border is also advantageous in that it can be used with conventional character generation processes of the operating system of the computer used to drive the display screen. In one embodiment, the novel display can be used within a portable computer system or other portable electronic device.

More specifically, an embodiment of the present invention includes a display unit (and a computer system including the display unit) comprising: a passive matrix of independently controllable pixels comprising n rows and m columns of discrete pixels, the passive matrix operable to generate an image in response to electronic signals driven from row and column drivers coupled to the passive matrix, the image representative of information stored in a frame buffer memory; and a pixel border having a predetermined width, the pixel border surrounding the passive matrix and comprising a plurality of pixels which are uniformly controlled between an on and an off state by a common threshold signal.

A display unit is constituted in one embodiment herein by a passive matrix of independently controllable pixels characterized by an active area of n rows and m columns of discrete pixels and a pixel border. In one embodiment, m and n are both 160. The passive matrix is operable to generate an image in response to electronic signals driven from row and column drivers coupled to it, representative of information stored in a frame buffer memory. The pixel border has a predetermined width, and surrounds the passive matrix active area. In one embodiment, the predetermined width is two pixels. The border pixel color state is controlled herein by the frame buffer memory. The pixel border color state is controlled to correspond to information contained in a locus of the frame buffer memory. This locus may be, in various embodiments herein, a single pixel, a row of pixels, or a number of rows of pixels of frame buffer memory. Each row of pixels may be equal to m and/or n, and may be 160. In one embodiment, the frame buffer controls the border pixels directly via a liquid crystal display controller and drivers, without a timing generation mechanism, such as a timing ASIC. In one embodiment, the display unit constitutes a part of a portable electronic device.

In one embodiment, a method of controlling the color of the border pixels constitutes a process including monitoring a locus within the frame buffer memory for information, determining a color for the border pixels corresponding thereto, generating a pixel border color signal corresponding to the color, transferring the pixel border color signal to the liquid crystal display controller, which generates a pixel border color writing signal and impels the drivers to write a color to the border pixels accordingly. The hardware abstraction layer monitors the frame buffer memory locus, determines the border pixel color, and generates the pixel border color signal. In one embodiment, impelling the drivers to write a color to the pixel border does not involve a timing synchronization mechanism external from the hardware abstraction layer.

DETAILED DESCRIPTION OF THE INVENTION

In the following detailed description of the present invention, a controllable pixel border for a negative display mode passive matrix display screen which provides contrast improvement for increased viewability of edge-displayed characters, numerous specific details are set forth in order to provide a thorough understanding of the present invention. However, it will be recognized by one skilled in the art that the present invention may be practiced without these specific details or with equivalents thereof. In other instances, well known methods, procedures, components, and circuits have not been described in detail as not to unnecessarily obscure aspects of the present invention.

The following co-pending US application is hereby incorporated by reference, Ser. No. 09/818,081, by Shawn Gettemy, Sherridythe Fraser, and David Lum, entitled "Controllable Pixel Border for a Negative Mode Passive Matrix Display Device," filed Mar. 26, 2001, itself a continuation-in-part of co-pending U.S. application Ser. No. 09/709,142, by Canova, et al., entitled "Pixel Border For Improved Viewability of a Display Device," filed Nov. 8, 2000 and which is also hereby incorporated by reference, both assigned to the assignee of the present invention.

Exemplary Portable Electronic Device Platform

Although the display screen of the present invention can be implemented in a variety of different electronic systems such as a pager, a cell phone, a remote control device, etc., one exemplary embodiment includes the integration of the display screen with a portable electronic device.

Figure 1A:
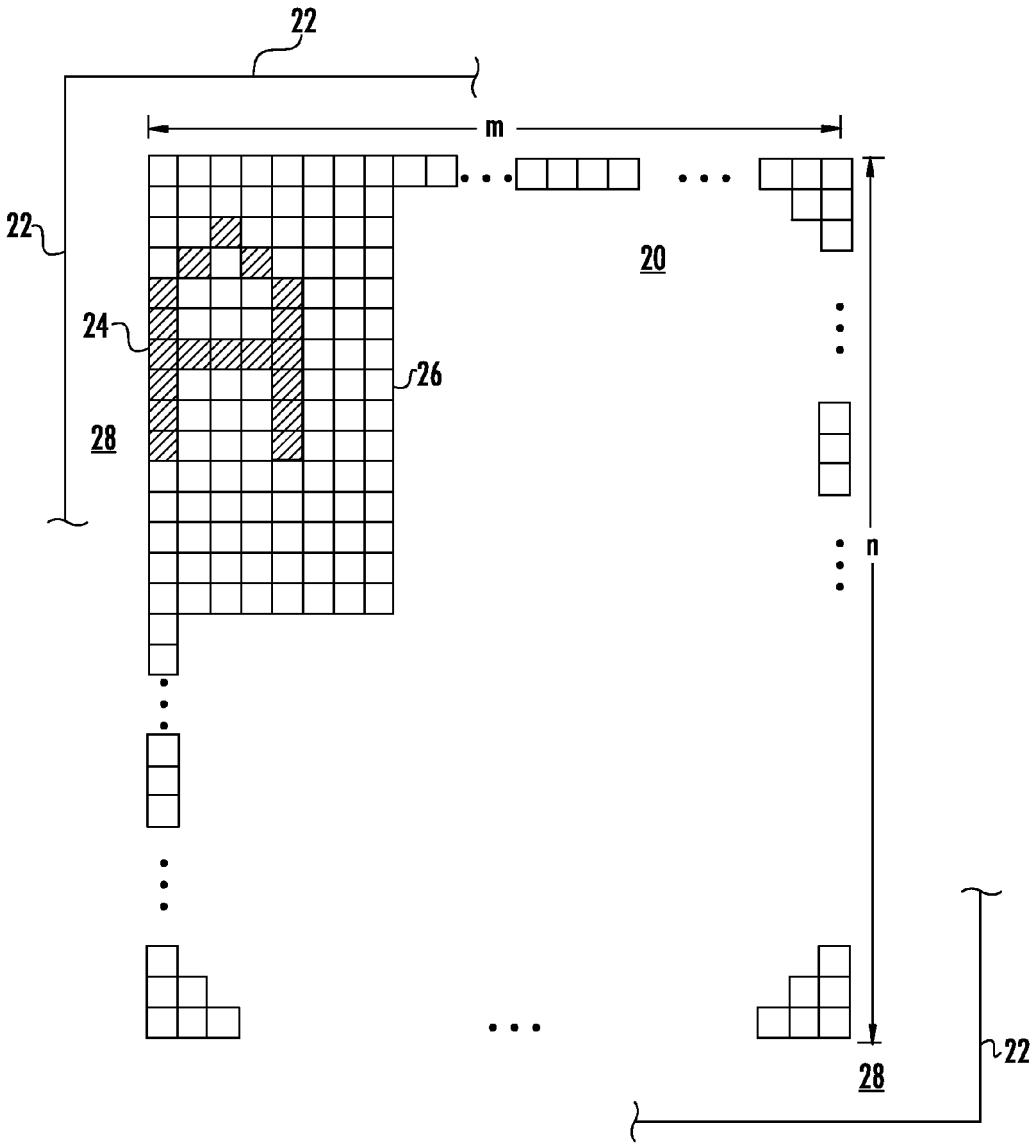
FIG. 1A illustrates a display screen of the prior art having an edge displayed character where the background pixels are light and the character is composed of darker pixels.
Figure 1B:
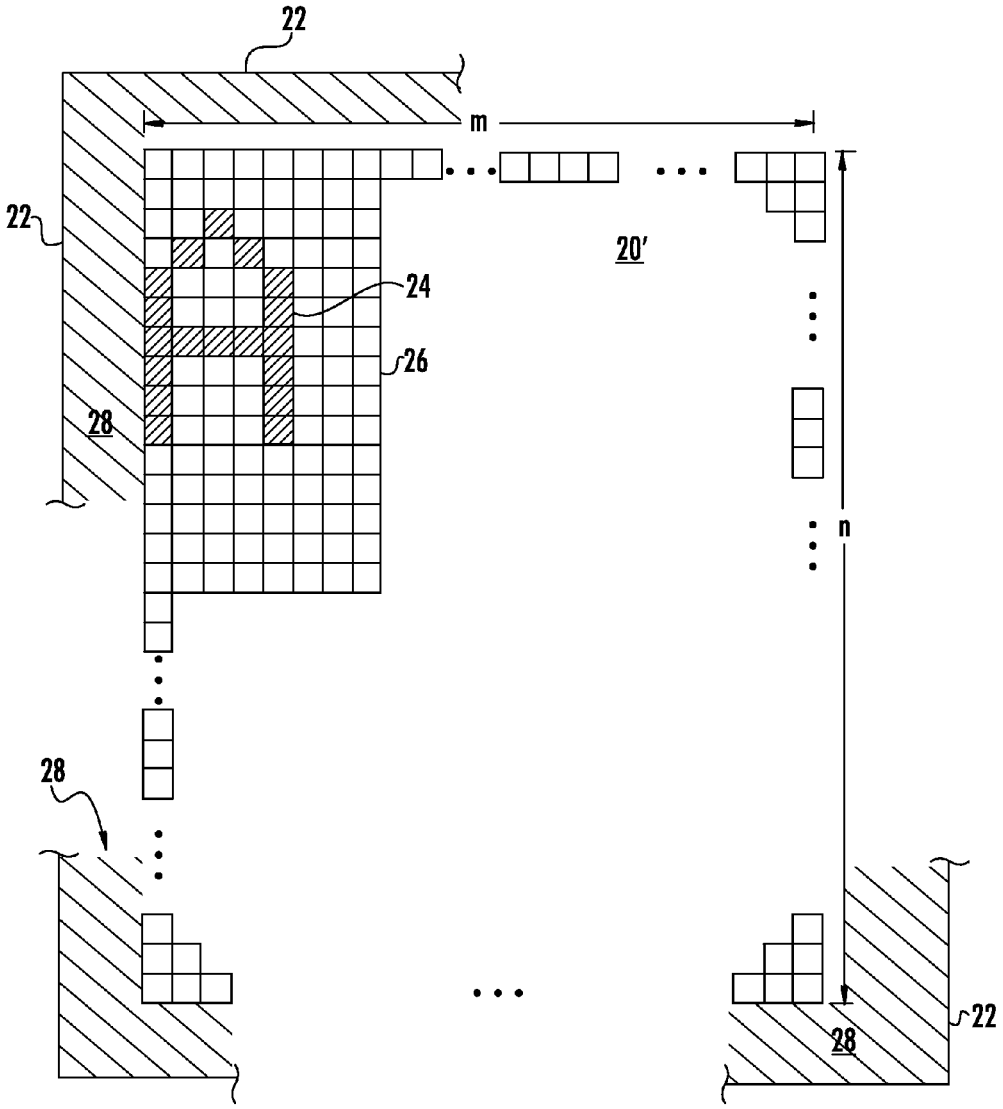
FIG. 1B illustrates a display screen of the prior art having an edge displayed character in a video format where the pixels of the character are of the same or similar color and shade as the edge region of the display panel.
Figure 2A:
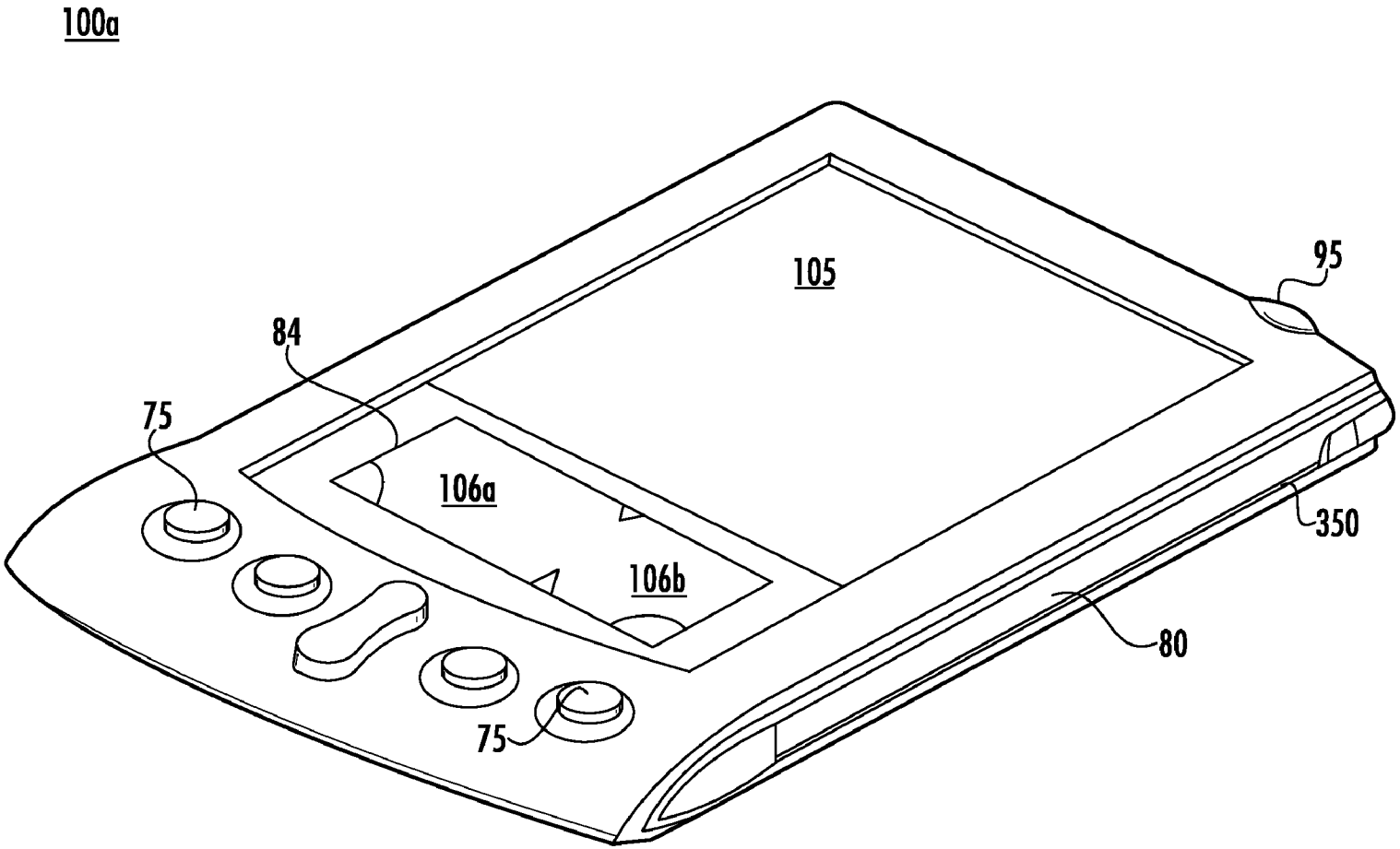
FIG. 2A is a top side perspective view of an exemplary palmtop computer system that can be used in one embodiment of the present invention.

FIG. 2A is a perspective illustration of the top face 100*a* of one embodiment of a palmtop computer system that can be used in one implementation of the present invention. The top face 110*a* contains the novel display screen 105 surrounded by a bezel or cover. A removable stylus 80 is also shown. The novel display screen 105 contains a transparent touch screen (digitizer) able to register contact between the screen and the tip of the stylus 80. The novel display screen 105 is described in more detail further below. The stylus 80 can be of any material to make contact with the screen 105. As shown in FIG. 2A, the stylus 80 is inserted into a receiving slot or rail 350. Slot or rail 350 acts to hold the stylus when the computer system 100*a* is not in use. Slot or rail 350 may contain switching devices for automatically powering down and automatically power up computer system 100*a* based on the position of the stylus 80. The top face 100*a* also contains one or more dedicated and/or programmable buttons 75 for selecting information and causing the computer system to implement functions. The on/off button 95 is also shown.

FIG. 2A also illustrates a handwriting recognition pad or "digitizer" containing two regions 106*a* and 106*b*. Region 106*a* is for the drawing of alpha characters therein for automatic recognition (and generally not used for recognizing numeric characters) and region 106*b* is for the drawing of numeric characters therein for automatic recognition (and generally not used for recognizing numeric characters). The stylus 80 is used for stroking a character within one of the regions 106*a* and 106*b*. The stroke information is then fed to an internal processor for automatic character recognition. Once characters are recognized, they are typically displayed on the screen 105 for verification and/or modification.

Figure 3:
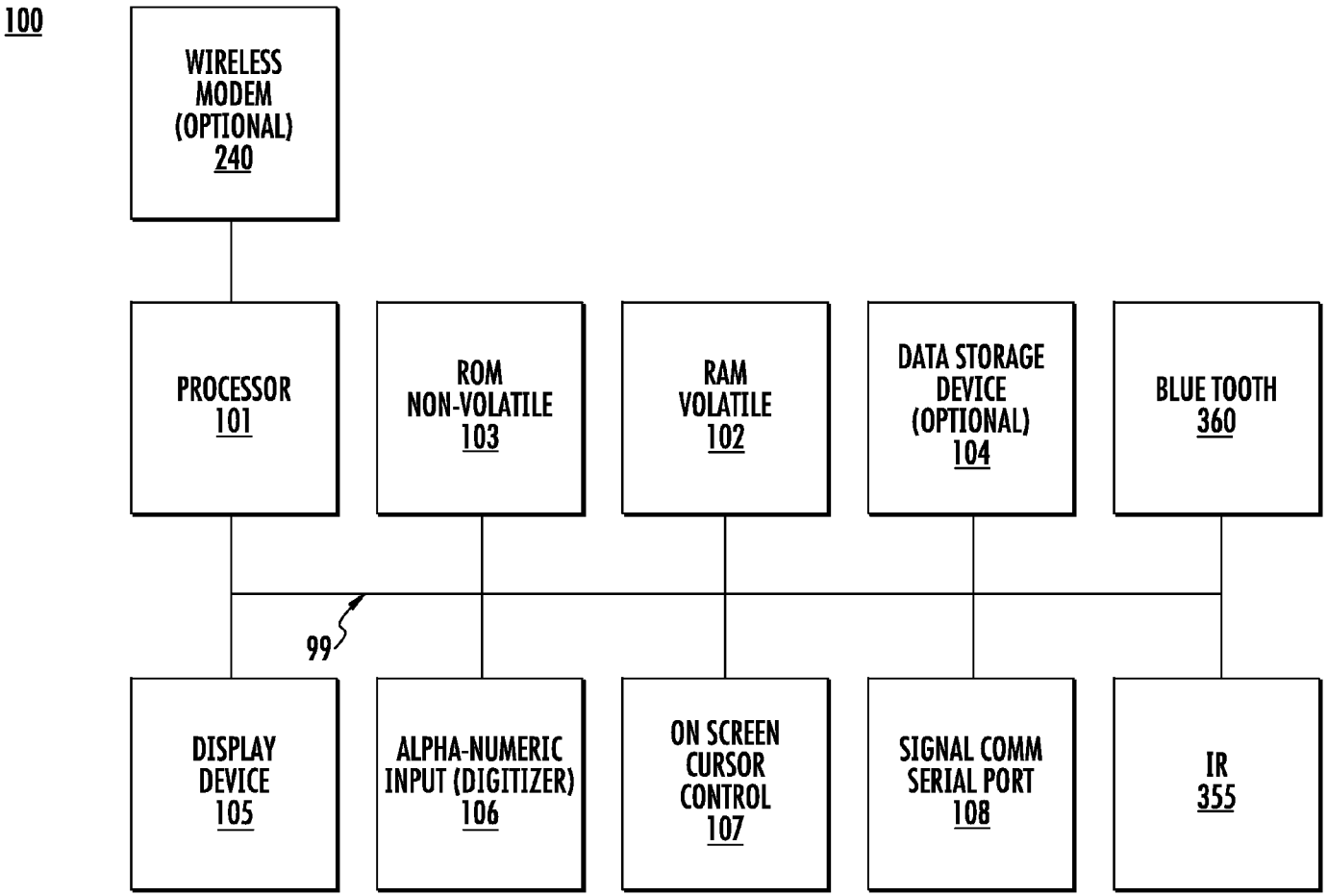
FIG. 3 is a logical block diagram of the exemplary palmtop computer system in accordance with an embodiment of the present invention.

The digitizer 160 records both the (x, y) coordinate value of the current location of the stylus and also simultaneously records the pressure that the stylus exerts on the face of the digitizer pad. The coordinate values (spatial information) and pressure data are then output on separate channels for sampling by the processor 101 (FIG. 3). In one implementation, there are roughly 256 different discrete levels of pressure that can be detected by the digitizer 106. Since the digitizer's channels are sampled serially by the processor, the stroke spatial data are sampled "pseudo" simultaneously with the associated pressure data. The sampled data is then stored in a memory by the processor 101 (FIG. 3) for later analysis.

Figure 2B:
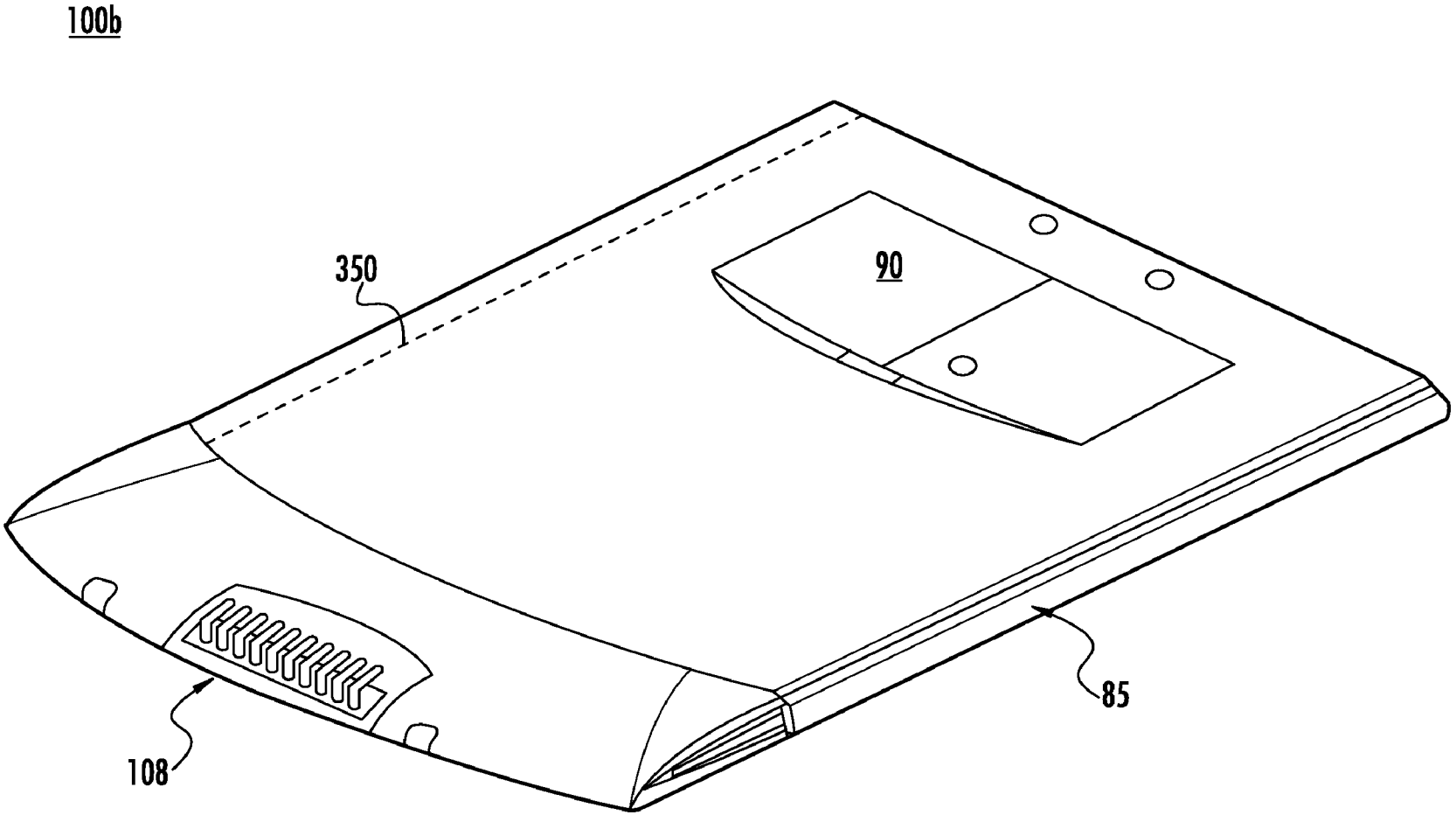
FIG. 2B is a bottom side perspective view of the exemplary palmtop computer system of FIG. 2A.

FIG. 2B illustrates the bottom side 100*b* of one embodiment of the palmtop computer system. An optional extendible antenna 85 is shown and also a battery storage compartment door 90 is shown. A communication interface 108 is also shown. In one embodiment of the present invention, the serial communication interface 108 is a serial communication port, but could also alternatively be of any of a number of well known communication standards and protocols, e.g., parallel, SCSI, Firewire (IEEE 1394), Ethernet, etc. In FIG. 2B is also shown the stylus receiving slot or rail 350.

Figure 2C:
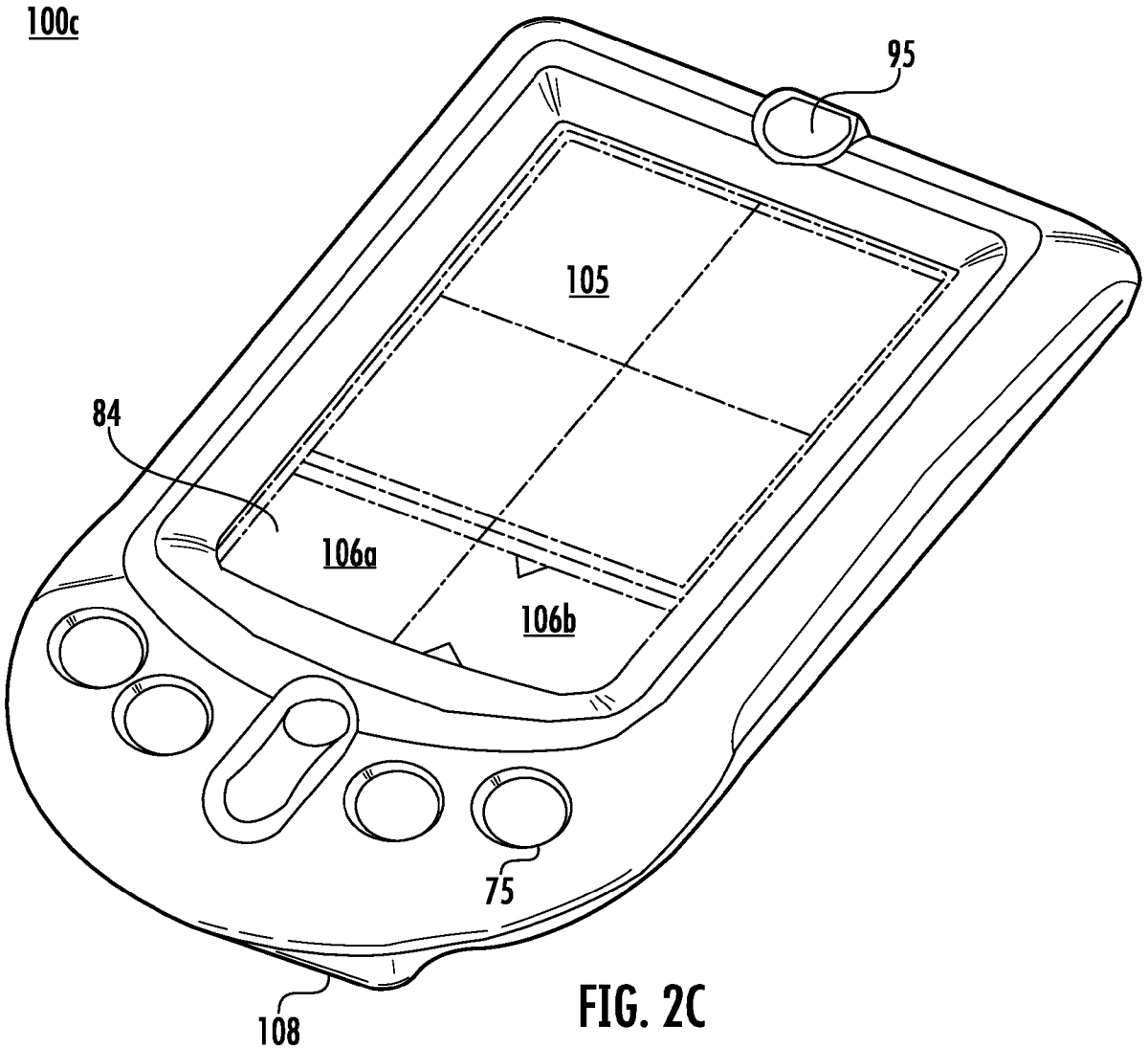
FIG. 2C is another exemplary computer system embodiment

FIG. 2C illustrates a front perspective view of another implementation of the palmtop computer system 100*c*. As shown, the flat central area is composed of the novel display screen area 105 and a thin silk screen layer material portion 84. Typically, the silk screen layer material portion 84 is opaque and may contain icons, buttons, images, etc., graphically printed thereon in addition to regions 106*a* and 106*b*. The novel display screen area 105 and portion 84 are disposed over a digitizer.

FIG. 3 illustrates circuitry of portable computer system 100. Computer system 100 includes an address/data bus 99 for communicating information, a central processor 101 coupled with the bus 99 for processing information and instructions, a volatile memory 102 (e.g., random access memory RAM) coupled with the bus 99 for storing information and instructions for the central processor 101 and a non-volatile memory 103 (e.g., read only memory ROM) coupled with the bus 99 for storing static information and instructions for the processor 101. Computer system 110 also includes an optional data storage device 104 (e.g., thin profile removable memory) coupled with the bus 99 for storing information and instructions. Device 104 can be removable. As described above, system 100 also contains a display device 105 coupled to the bus 99 for displaying information to the computer user.

Also included in computer system 100 of FIG. 3 is an alphanumeric input device 106 which in one implementation is a handwriting recognition pad ("digitizer") having regions 106*a* and 106*b* (FIG. 2A), for instance. Device 106 can communicate information (spatial data and pressure data) and command selections to the central processor 101.

System 110 also includes an optional cursor control or directing device 107 coupled to the bus for communicating user input information and command selections to the central processor 101. In one implementation, device 107 is a touch screen device (also a digitizer) incorporated with screen 105. Device 107 is capable of registering a position on the screen 105 where the stylus makes contact and the pressure of the contact. The digitizer can be implemented using well known devices, for instance, using the ADS-7846 device by Burr-Brown that provides separate channels for spatial stroke information and pressure information.

The display device 105 utilized with the computer system 100 may be a liquid crystal device, cathode ray tube (CRT), field emission device (FED, also called fiat panel CRT) or other display device suitable for creating graphic images and alphanumeric characters recognizable to the user. Any of a number of display technologies can be used, e.g., LCD, FED, plasma, etc., for the flat panel display 105. In one embodiment, the display 105 is a flat panel multi-mode display capable of both monochrome and color display modes.

Signal communication device 108, also coupled to bus 99, can be a serial port (or USB port) for communicating with the cradle 60. In addition to device 108, wireless communication links can be established between the device 100 and a host computer system (or another portable computer system) using a Bluetooth wireless device 360, an infrared device 355, or a GSM radio device 240. Device 100 may also include a wireless modem device 240 and/or a wireless radio, e.g., a GSM wireless radio with supporting chipset. The wireless modem device 240 is coupled to communicate with the processor 101 but may not be directly coupled to port 108.

In one implementation, the Mobitex wireless communication system may be used to provide two way communication between system 100 and other networked computers and/or the Internet via a proxy server. In other embodiments, TCP protocol can be used or SMS can be used. System 100 of FIG. 4 may also contain batteries for providing electrical power. Replaceable cells or rechargeable batteries can be used. Well known electronics may be coupled to the battery to detect its energy level and this information can be sampled by the processor 101.

Figure 4:
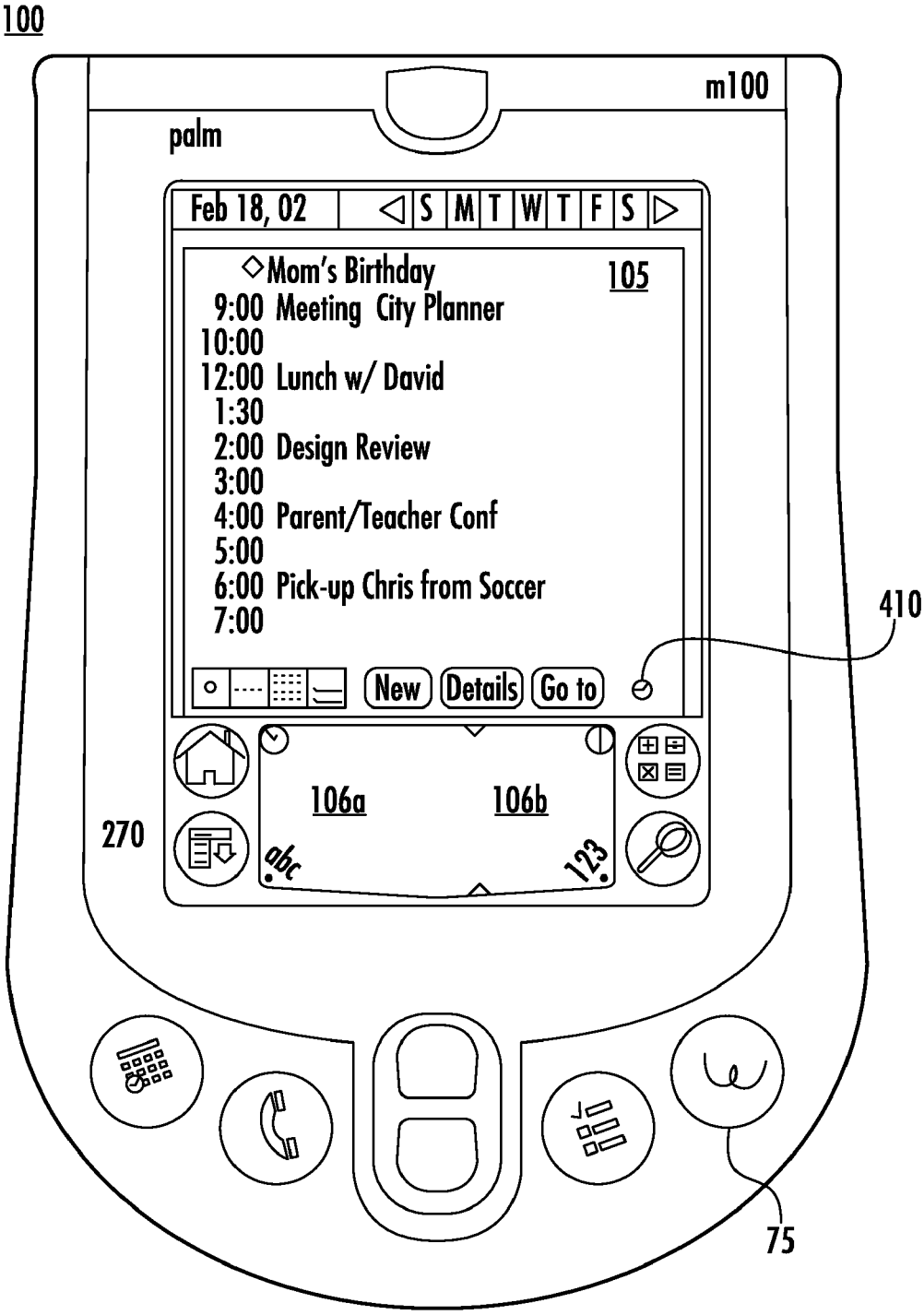
FIG. 4 is a front view of the exemplary computer system that can be used within the display screen of the present invention.

FIG. 4 is a front view of the exemplary palmtop computer system 100 having an exemplary display within screen 105. The exemplary display contains one or more graphical user interface elements including a menu bar and selectable on-screen buttons 410. Buttons on screen 105 can be selected by the user directly tapping on the screen location of the button with stylus 80 as is well known. Also shown are two regions of digitizer 106*a* and 106*b*. Region 106*a* is for receiving user stroke data (and pressure data) for alphabet characters, and typically not numeric characters, and region 106*b* is for receiving user stroke data (and pressure data) for numeric data, and typically not for alphabetic characters. Physical buttons 75 are also shown. Although different regions are shown for alphabetic and numeric characters, the device is also operable within a single region that recognizes both alphabetic and numeric characters.

It is appreciated that, in one embodiment, the digitizer region 106*a* and 106*b* are separate from the display screen 105 and therefore does not consume any display area.

Figure 5:
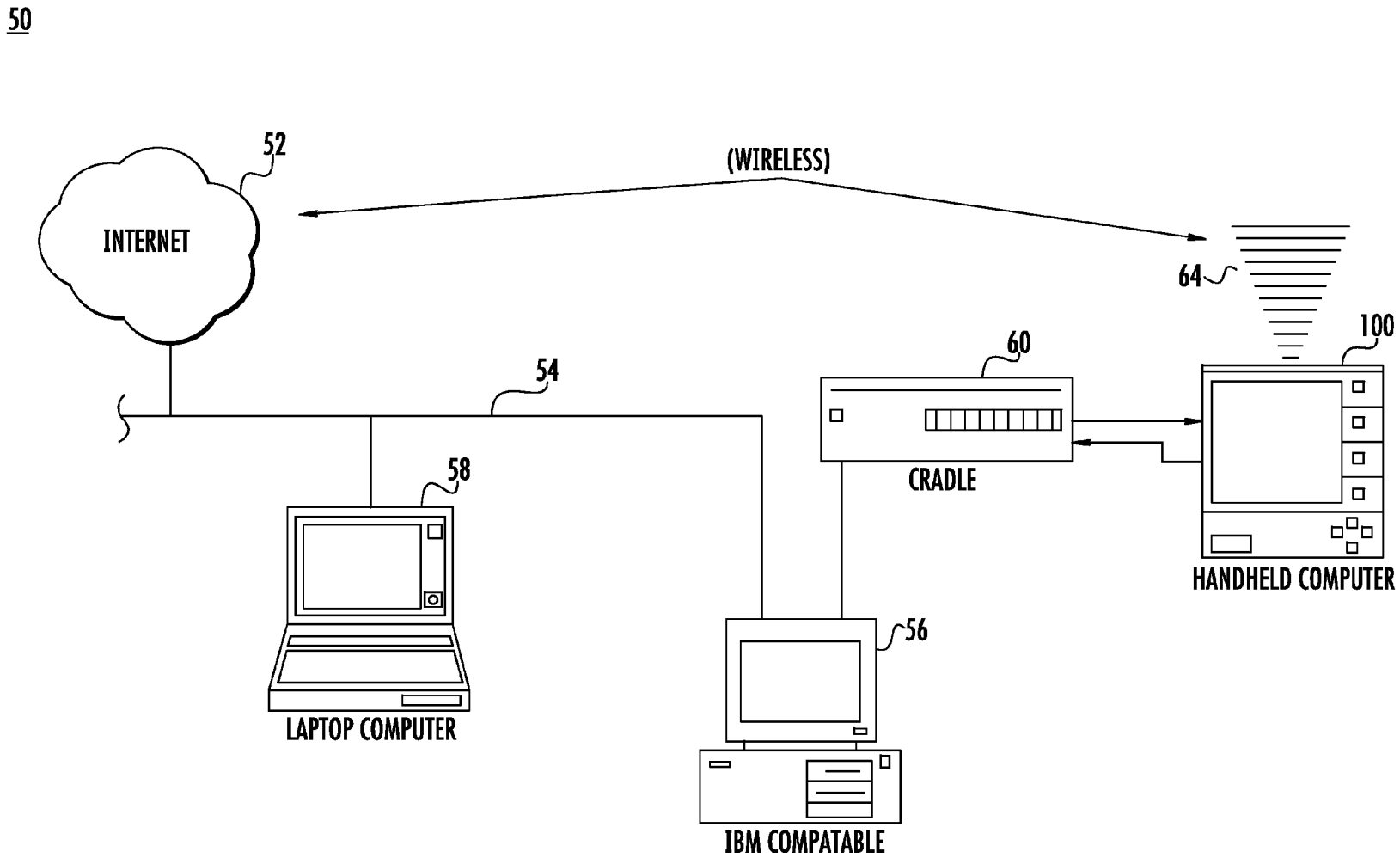
FIG. 5 is an exemplary communication network in which the exemplary palmtop computer can be used.

FIG. 5 illustrates a communication system 50 that can be used in conjunction with the palmtop computer system 100. System 50 is exemplary and comprises a host computer system 56 which can either be a desktop unit as shown, or, alternatively, can be a laptop system 58. Optionally, one or more host computer systems can be used within system 50. Host computer systems 58 and 56 are shown connected to a communication bus 54, which in one embodiment can be a serial communication bus, but could be of any of a number of well known designs, e.g., a parallel bus, Ethernet Local Area Network (LAN), etc. Optionally, bus 54 can provide communication with the Internet 52 using a number of well known protocols.

Importantly, bus 54 is also coupled to a cradle 60 for receiving and initiating communication with a palm top ("palm-sized") portable computer system 100 of the present invention. Cradle 60 provides an electrical and mechanical communication interface between bus 54 (and anything coupled to bus 54) and the computer system 100 for two way communications. Computer system 100 also contains various wireless communication mechanisms 64 for sending and receiving information from other devices, specifically a wireless modem 240 (FIG. 3) can be used to communicate with the Internet 52.

Figure 6:
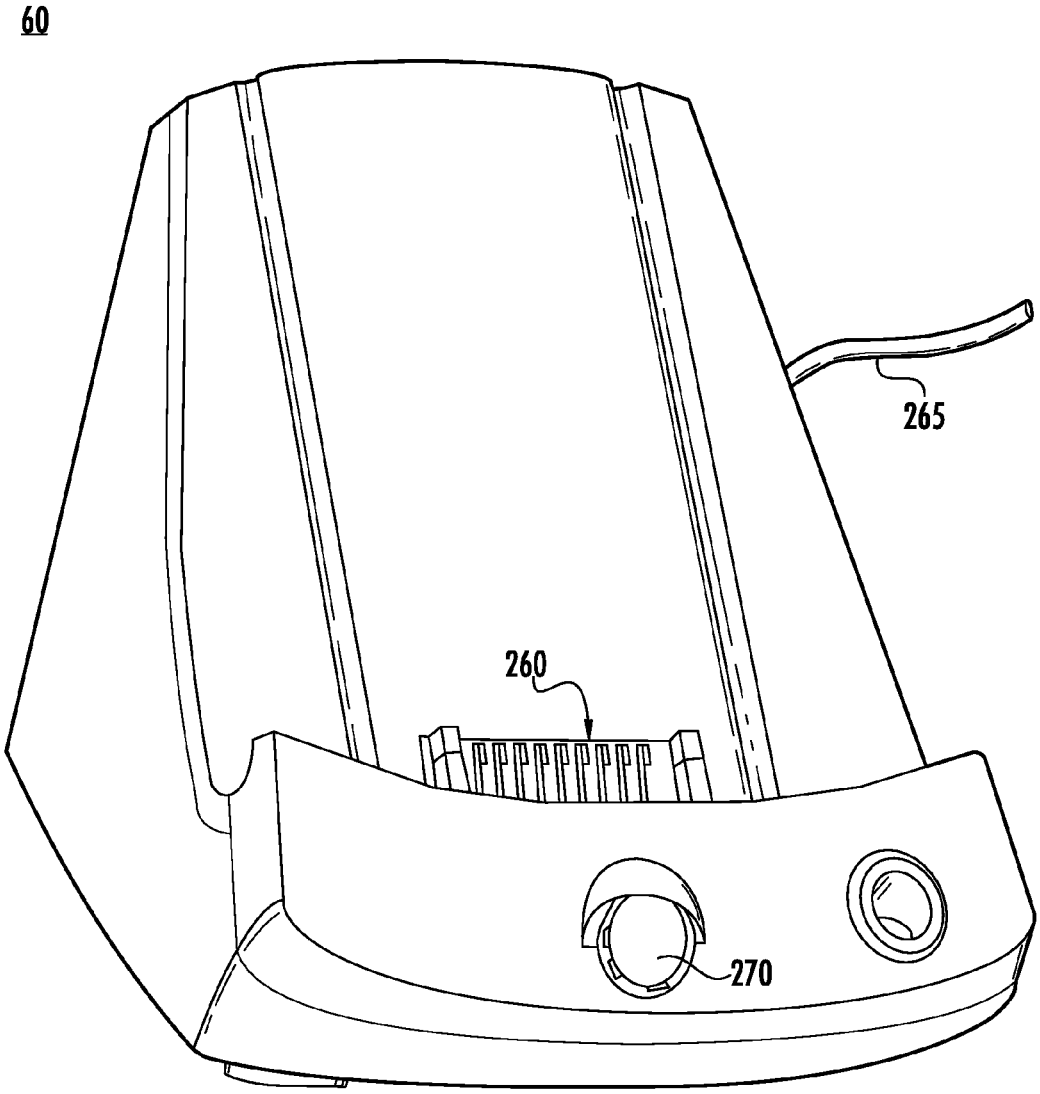
FIG. 6 is a perspective view of a cradle device for connecting the exemplary palmtop computer system to other systems via a communication interface.

FIG. 6 is a perspective illustration of one embodiment of the cradle 60 for receiving the palmtop computer system 100. Cradle 60 contains a mechanical and electrical interface 260 for interfacing with serial connection 108 (FIG. 2B) of computer system 100 when system 100 is slid into the cradle 60 in an upright position. Once inserted, button 270 can be pressed to initiate two way communication between system 100 and other computer systems coupled to serial communication 265.

Figure 7:
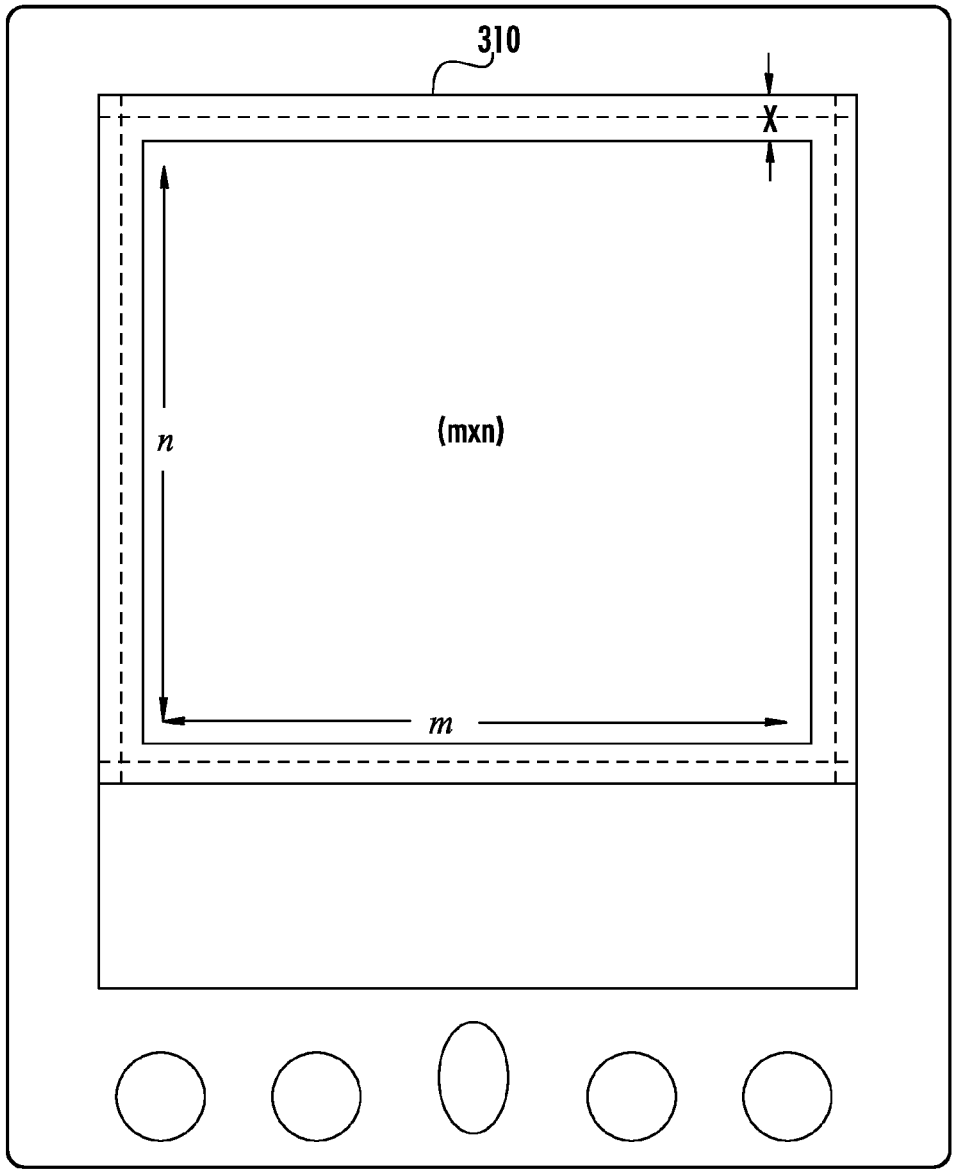
FIG. 7 illustrates a display screen in accordance with one embodiment of the present invention including a controllable border pixel region and a frame buffer pixel region using a passive matrix display.

Controllable Pixel Border of the Present Invention for a Passive Matrix Display Using Negative Mode Display FIG. 7 illustrates a front view of the display screen in accordance with an embodiment of the present invention. The display screen 310 contains two different display regions. Region 314 is the frame buffer pixel region and contains a matrix of discrete pixels (color or black and white) oriented in n rows and m columns according to a variety of display dimensions and formats. Region 314 generates an image that is a representation of data stored in a frame buffer memory (also called video memory) of computer system 100. Although region 314 can have any dimension, in one embodiment it includes the dimensions of 160 pixels by 160 pixels. The computer system, e.g., the operating system, controls the information that is stored into the frame buffer memory and thereby controls the pixels of region 314. In one embodiment of the present invention, the frame buffer region 314 is implemented with passive display technology, e.g., passive matrix liquid crystal display (LCD) technology. However, any number of well known passive matrix technologies could also be used, such as, electronic paper, electronic ink and microelectromechanical systems (MEMS).

In one embodiment, the passive matrix technology used is negative mode display supertwisted nematic LCD technology. In negative mode display, the pixels are naturally black when in the off state and are bright when turned on.

Surrounding region 314 of FIG. 7 is a novel pixel border region 312 in accordance with the present invention and having a predetermined pixel width, x. The pixels of the pixel border region 312 are not independently addressable, like the pixels of the frame buffer region 314, but are rather uniformly controllable between an on state and an off state by a single control signal that is under processor control. Although the width, x, of the pixel border region 312 is arbitrary, in one embodiment the width is two pixels. The pixel border region 312 of the present invention is not controlled by the frame buffer memory, but rather by the single control signal discussed above. Like the frame buffer region 314, the pixel border region 312 is also implemented using a negative mode display passive matrix display technology.

The pixel border region 312 is useful for giving contrast improvement for the viewability of edge located characters. In one implementation, the present invention uses negative mode display LCD in which the pixels are naturally black. Using this technology, in one display format, the background pixels are driven to be bright or white, while the foreground pixels (e.g., those that make up the characters in a text display) are darker or black. In this mode, the pixels of the pixel border 312 are generally displayed white to match the background pixel color. Specifically, the pixel border 312 is useful for giving contrast improvement for characters displayed along the edges, e.g., upper, lower, right and left, of region 314 (see FIG. 14). The total viewing area (in pixels) of the display screen when x=2 is therefore n+4 rows and m+4 columns.

Figure 8:
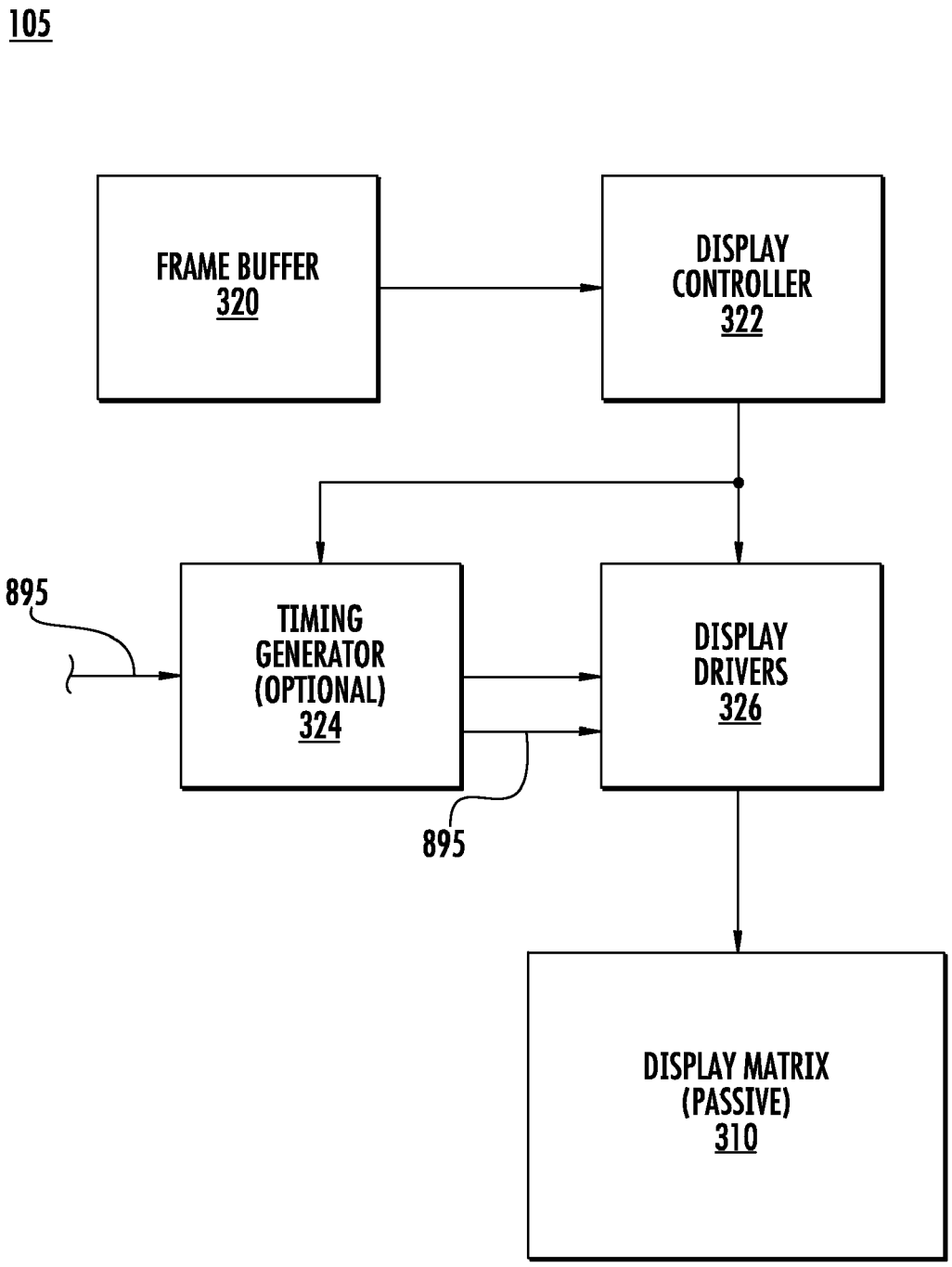
FIG. 8 is a block diagram of the display unit in accordance with one embodiment of the present invention.

FIG. 8 illustrates a logical diagram of the components of the novel display unit 105 in accordance with an embodiment of the present invention. Frame buffer memory 320 contains a bitmapped image for display. This frame buffer is read, periodically, by a display controller 322. The display controller 322 is well known. Display controller 322 is either coupled directly to a display driver 326 or to a timing generator 324. Controller 322 generates well known timing signals, such as vertical and horizontal synchronization signals, as well as clocking signals; all required to properly propagate image data into the display drivers 326. The timing generator 324 is sometimes needed to convert the signals from the controller according to the requirements of the drivers.

It is appreciated that if drivers are available to drive a matrix larger in size than the frame buffer region, then in this alternative case, the conventional drivers may be used to drive the pixels of the border region in accordance with the present invention. In this particular embodiment, the timing generator will supply the border data to the border pixels.

The display drivers 326 are coupled to the pixels within the display matrix 310. The display matrix 310 generates images by the modulation of light by discrete pixel elements. The display matrix 310 can be a passive-matrix liquid crystal display (LCD) technology but could also be of any passive display technology, as described above.

FIG. 8 also illustrates the single control signal 895 that is under processor control. This signal indicates the display mode of the pixel border region 312. If this signal 895 is asserted, then the all the pixels of the border 312 are uniformly turned on, e.g., remain white or bright until this signal changes. If this signal 895 is not asserted, then all the pixels of the border 312 are uniformly turned off, e.g., remain black or dark until this signal changes. In normal display operations, when the background pixels are white and the foreground pixels are dark, e.g., reverse video, then the border pixels are turned on to provide contrast for edge displayed characters when using negative mode display LCD.

Figure 9:
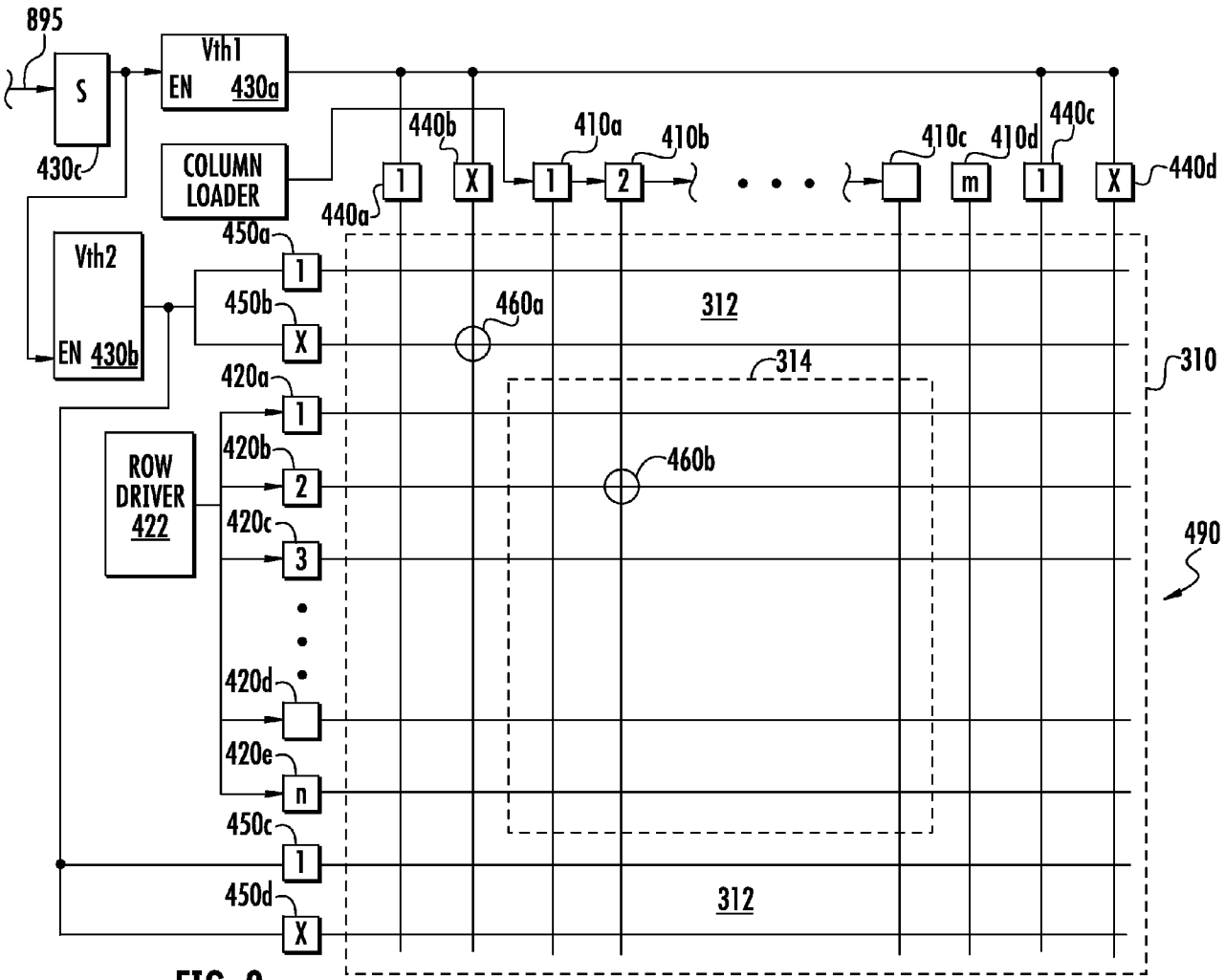
FIG. 9 is a logical block diagram of the display driver circuitry and passive matrix structure, with controllable pixel border regions, in accordance with an embodiment of the present invention.

FIG. 9 illustrates one implementation of the circuitry of the display drivers 326 and the display matrix 310 (of FIG. 8). In this example, x=2, but could be any width in accordance with the present invention. There are n row drivers 420*a*-420*e* and m column drivers 410*a*-410*d* which make up the frame buffer region 314. In color implementations, three subpixels, red, green, and blue, are required to form a single pixel and therefore 3m column drivers are required. Each column driver and each row driver is coupled to a respective column line and a respective row line. 2x Row drivers 450*a*-450*d* and 2x column drivers 440*a*-440*d* are used for the pixels of the border region 312.

Figure 10:
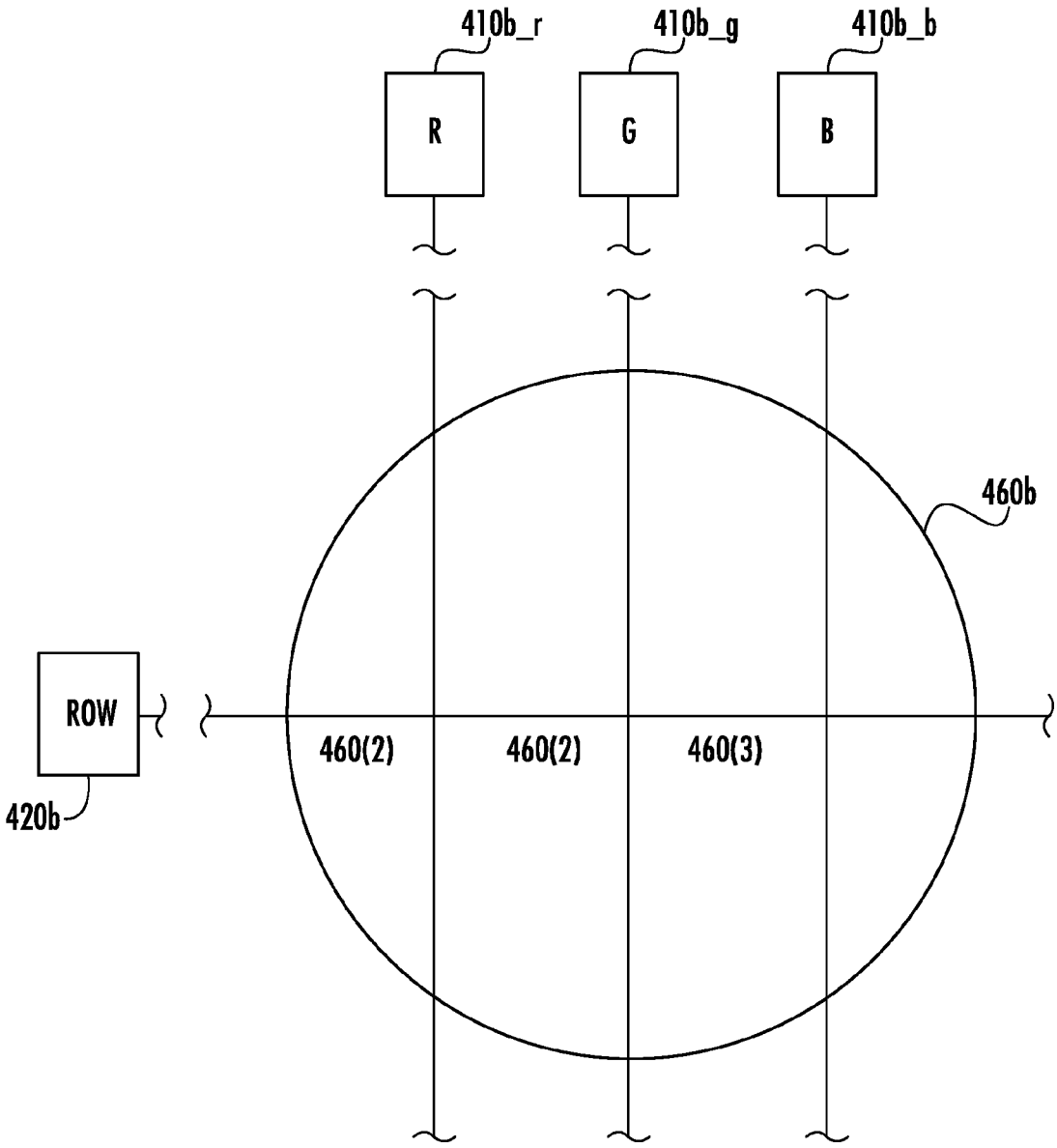
FIG. 10 illustrates the components of a color pixel of the passive matrix structure in accordance with one embodiment of the present invention.

In passive LCD technology, the pixels comprise the intersection of one row line and one column line, e.g., the intersection of two electrodes, and typically does not include any active element. An exemplary pixel 460*b* of the matrix region 314 is shown and an exemplary pixel 460*a* of the border region 312 is shown. Pixel 460*b* is shown in more detail in FIG. 10 for the color implementation and is comprised of three RGB subpixels 460(1)-460(3). Three column drivers 410*b*_r, 410*b*_g and 410*b*_b are used in the color implementation.

Driving signals are synchronized to meet, in time, at the intersection of a row and a column line to activate the respective pixel with a localized electric field, as is well known, to switch the pixel. The rows 420 of the frame buffer matrix 314 are scanned sequentially (according to synchronized row driver 422) from row 1 to row n to display a frame within region 314. Frames are generated from 30-50 Hz. For each row on-time, associated column data is shifted into the column drivers 410 by a column loader 412. In one example, the row on-time signal may be a square pulse for each column of data, from column 1 to column m. The column line then has its own pulse which depends on the gray scale of the pixel. However, the present invention may operate with any of the well known passive matrix driving schemes.

According to FIG. 9, the row and column drivers used for the pixel border do not sequentially scan in one embodiment. In the embodiment discussed above where conventional drivers are available to drive the border pixels, then in this case, row and column drivers used for the pixel border could sequentially scan. The 2x row drivers 450*a*-450*d* of the pixel border region 312 are coupled to a threshold voltage driver 430*b* which provides a constant common voltage level (Vth2) when in the on state. Likewise, the 2x column drivers 410*a*-410*d* of the pixel border region 312 are coupled to a threshold voltage driver 430*a* which provides a constant common voltage level (Vth1) when in the on state. The difference between these threshold voltage levels comprises a threshold voltage (V2). The voltage V2, or a greater amount, is common to and applied to all pixels of the border region 312 uniformly when in the on state. The difference between these threshold voltage levels comprises a threshold voltage (V1). The voltage V1, or less, is common to and applied to all pixels of the border region 312 uniformly when in the OFF state.

Figure 11:
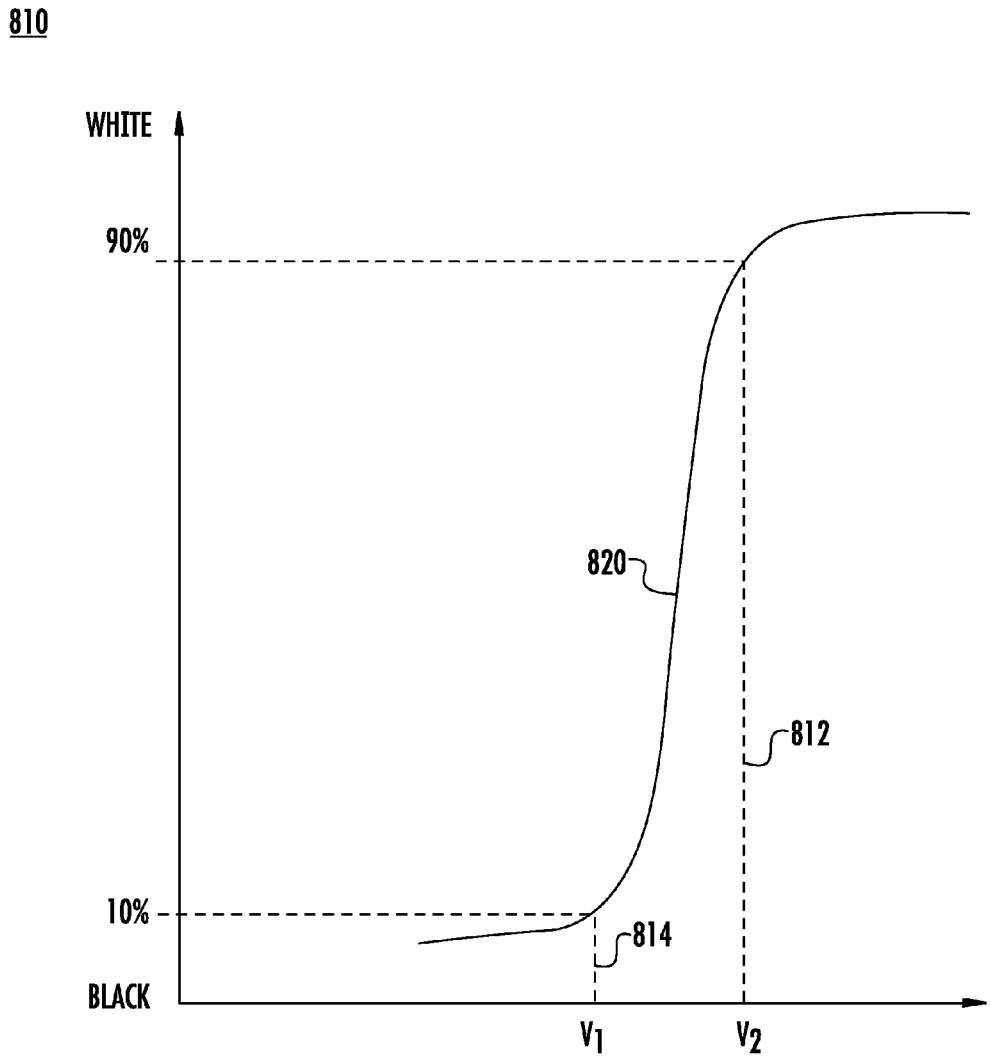
FIG. 11 is a voltage transfer case of the passive matrix structure in accordance with one embodiment of the present invention.

As shown by the voltage transfer curve 810 for the negative mode display supertwisted nematic LCD of FIG. 11, the threshold voltage, V1, achieves 10 percent white or less, which is considered black. The threshold voltage, V2, achieves 90 percent white or more, which is considered white. It is appreciated that the 10 percent or the 90 percent values used above are exemplary only and can be adjusted based on user preference.

The threshold driver circuits 430*a* and 430*b* of FIG. 9 are enabled via a switch circuit 430*c* which receives a signal control signal 895. When enabled, the constant voltage V2 is applied to the pixels of the pixel border region 312 and the pixel border 312 becomes white. When not enabled, no voltage, or a voltage of less than V1 is applied to the pixels of the pixel border region 312 and the pixel border 312 becomes dark. Signal 895 is processor controlled and can be made available to the operating system of computer 100.

Figure 12:
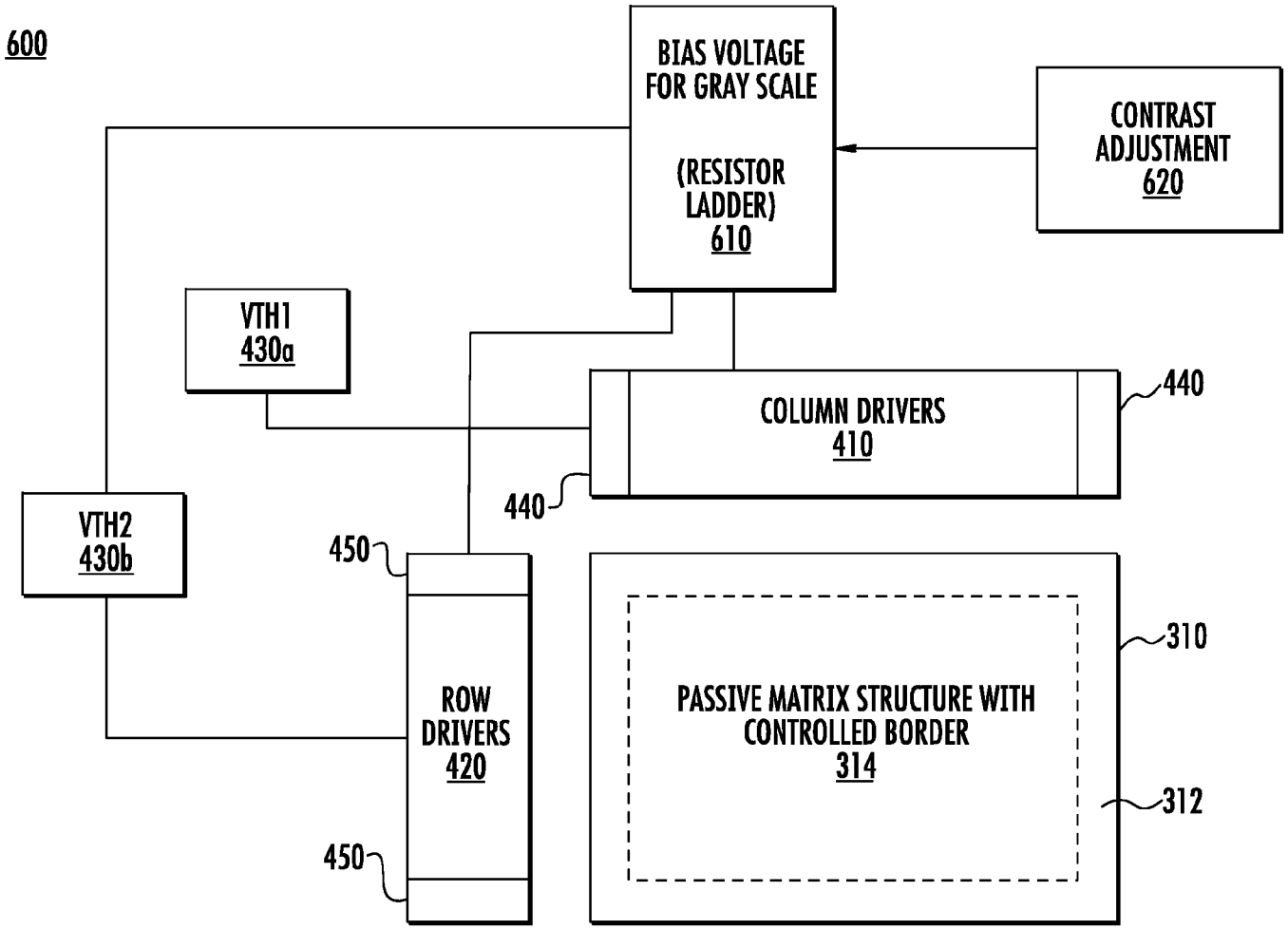
FIG. 12 is a logical block diagram of the display in accordance with one embodiment of the present invention having an adjustable threshold voltage applied to the controllable pixel border regions.

FIG. 12 illustrates a block diagram of display circuit 600 which includes the column drivers 410 and 440 and row drivers 420 and 450 which drive the passive matrix 310. Also shown, are the threshold voltage drivers 430*a* and 430*b*. As shown in FIG. 12, a gray scale bias voltage circuit 610 is used to control the generation of the threshold voltages which are used to provide the different gray scales used by the pixels in the frame buffer memory 312. In one embodiment, a resistor ladder circuit can be used as circuit 610 to generate the threshold voltages. Importantly, a contrast adjustment circuit 620 varies the bias voltage applied to circuit 610 thereby providing a mechanism for uniformly adjusting the gray scale voltages produced by circuit 610 to thereby adjust the contrast of region 314.

Advantageously, circuit 610 of FIG. 12 also generates a threshold voltage that is supplied to driver circuits 430*a* and 430*b*. The threshold voltage supplied to driver circuits 430*a*-430*b* varies based on the contrast adjustment and effects the values of V1 and V2 that are applied to the pixels of the border region 312. In this case, any variation in the contrast of region 314 can be matched by a corresponding and like variation in the contrast of region 312. Therefore, the contrast of regions 314 and 312 will be matched in response to any contrast variation by circuit 620. It is appreciated that contrast adjustment circuit 620 can include a manual adjustment that is user controlled or it can include an automatic adjustment that is based on environmental conditions, such as temperature, ambient lighting, etc.

Figure 13A:
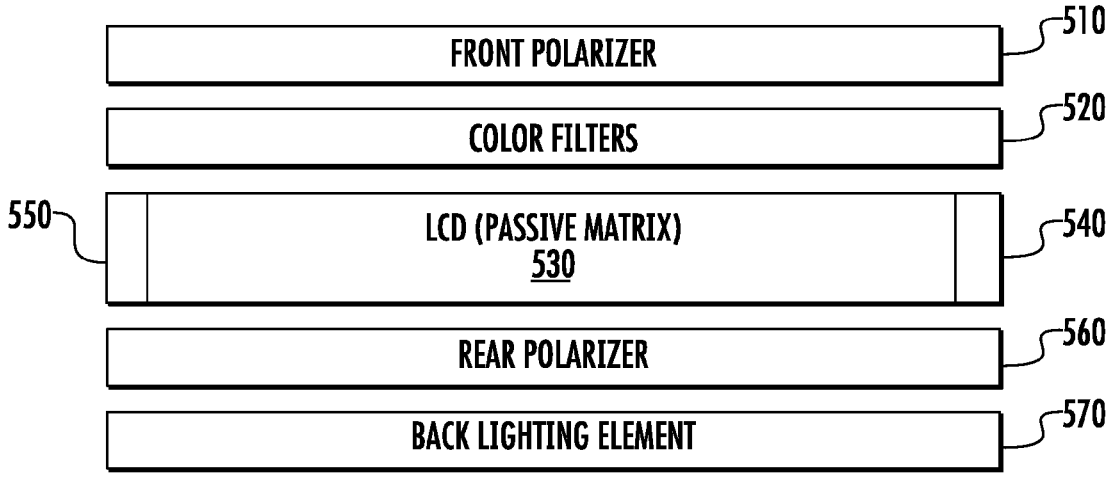
FIG. 13A is a cross sectional view of a backlit display matrix including a cross sectional view of the passive matrix controllable pixel border region in accordance with an embodiment of the present invention.

FIG. 13A illustrates a cross section of a transflective or transmissive display matrix 310 in accordance with one embodiment of the present invention. In this embodiment, a backlighting element 570, e.g., a cold cathode fluorescent (CCF) tube or other lighting device, is illustrated adjacent to a rear polarizer layer 560. A passive matrix LCD layer 530 is also shown. The passive matrix layer 530 maps to region 314 and may control n rows and m columns of pixels. Region 540 and region 550 correspond to the pixel border 312. An optional color filter pattern 520 is also shown. After the color filter pattern 520, a front polarizer layer 510 is provided.

Figure 13B:
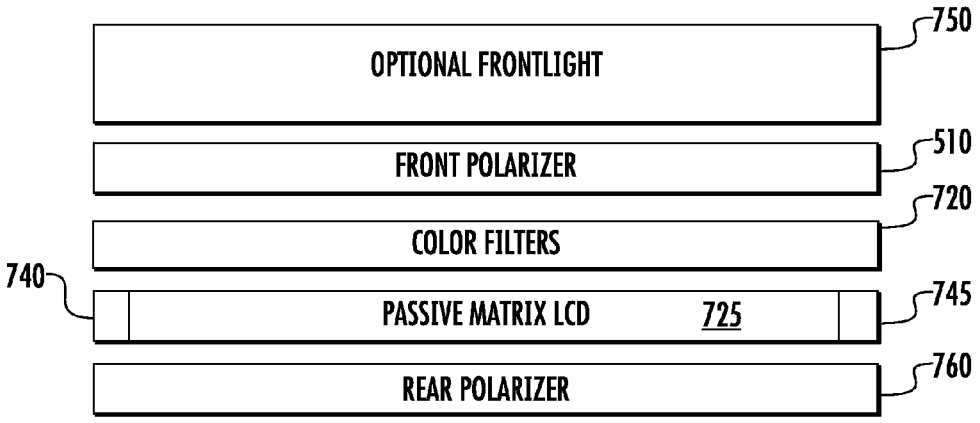
FIG. 13B is a cross sectional view of a reflective display matrix including a cross sectional view of the passive matrix controllable pixel border region in accordance with an embodiment of the present invention.

FIG. 13B illustrates a cross section of a reflective display matrix 710 in accordance with one embodiment of the present invention. In this embodiment, a reflective passive matrix LCD layer 725 is used. Layer 725 maps to region 314 and may control n rows and m columns of pixels. Region 740 and region 745 correspond to the pixel border 312. An optional frontlight layer 750 can be used and a front polarizer 510 is shown along with a rear reflector 760. The color filter pattern 720 can be used.

Figure 14:
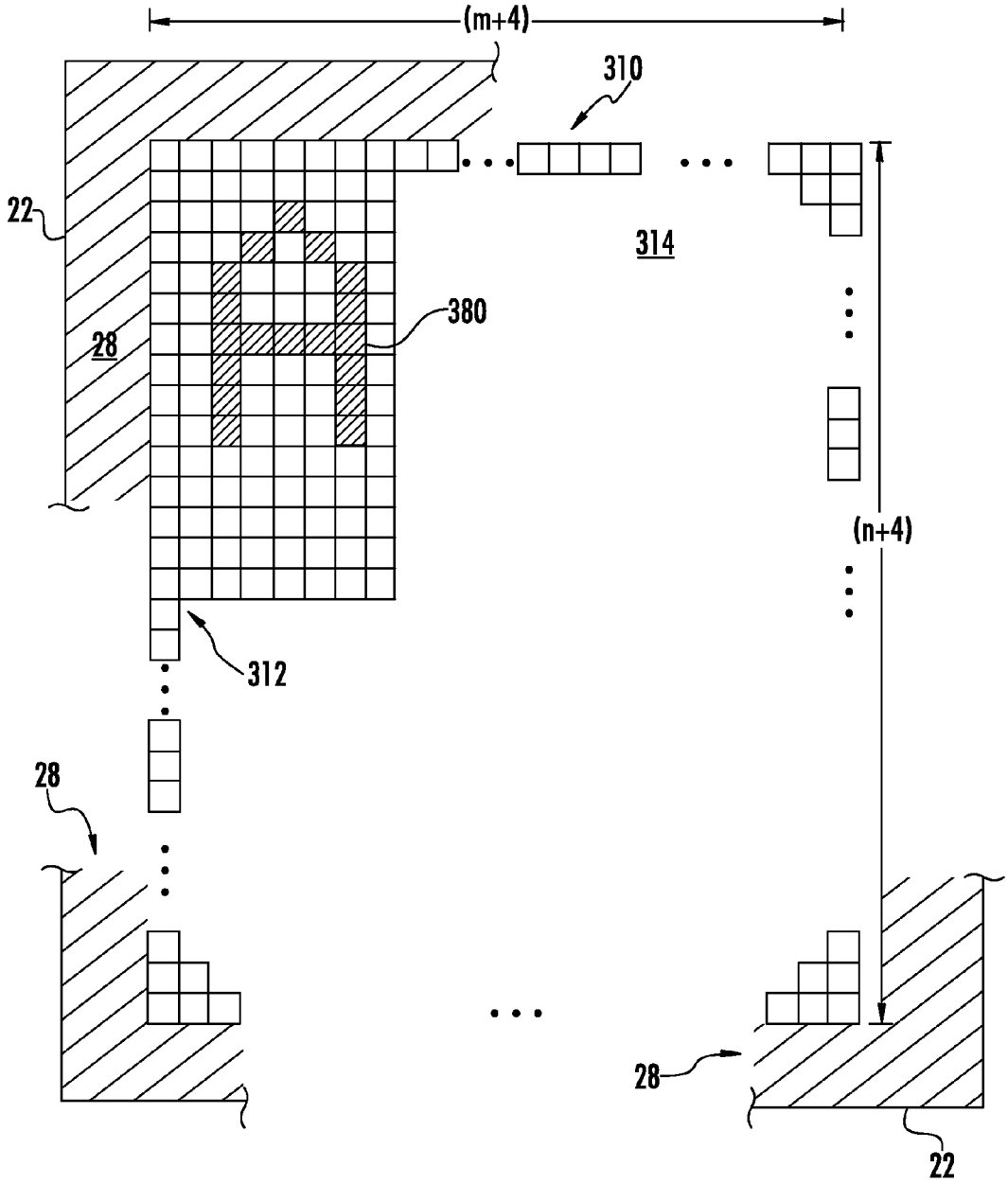
FIG. 14 is an exemplary display using the display unit with controllable pixel border in accordance with one embodiment of the present invention and having a negative mode passive matrix display.

FIG. 14 illustrates a resultant display in accordance with the present invention using a pixel border of width x=2. The pixels 380 of the edge displayed character, "A," are dark and the background pixels are white in this case, e.g., one exemplary form of a reverse video display format. The display is negative mode LCD. The edge region 28 of the display panel is dark, e.g., the same or similar color as the pixels 380 of the character. In this exemplary case, the border pixels 312 of the present invention are driven white. The total number of pixels in the display 310 are (m+2x) by (n+2x).

By providing a white border region 312, the contrast along the left edge of the character, "A," is much improved thereby improving viewability of the character. This advantageous result is achieved without any requirement of changing the operating system of the computer because the standard (m×n) pixel region 314 of the display remains unchanged. Furthermore, because the border pixels of region 312 have their own special driver circuitry, standard (m×n) driver circuits and software can be used with the present invention to generate images within region 314.

Apparatus and Methods to Achieve a Variable Color Pixel Border on a Negative Mode Screen with a Passive Matrix Drive

Exemplary Logical System

Figure 15:
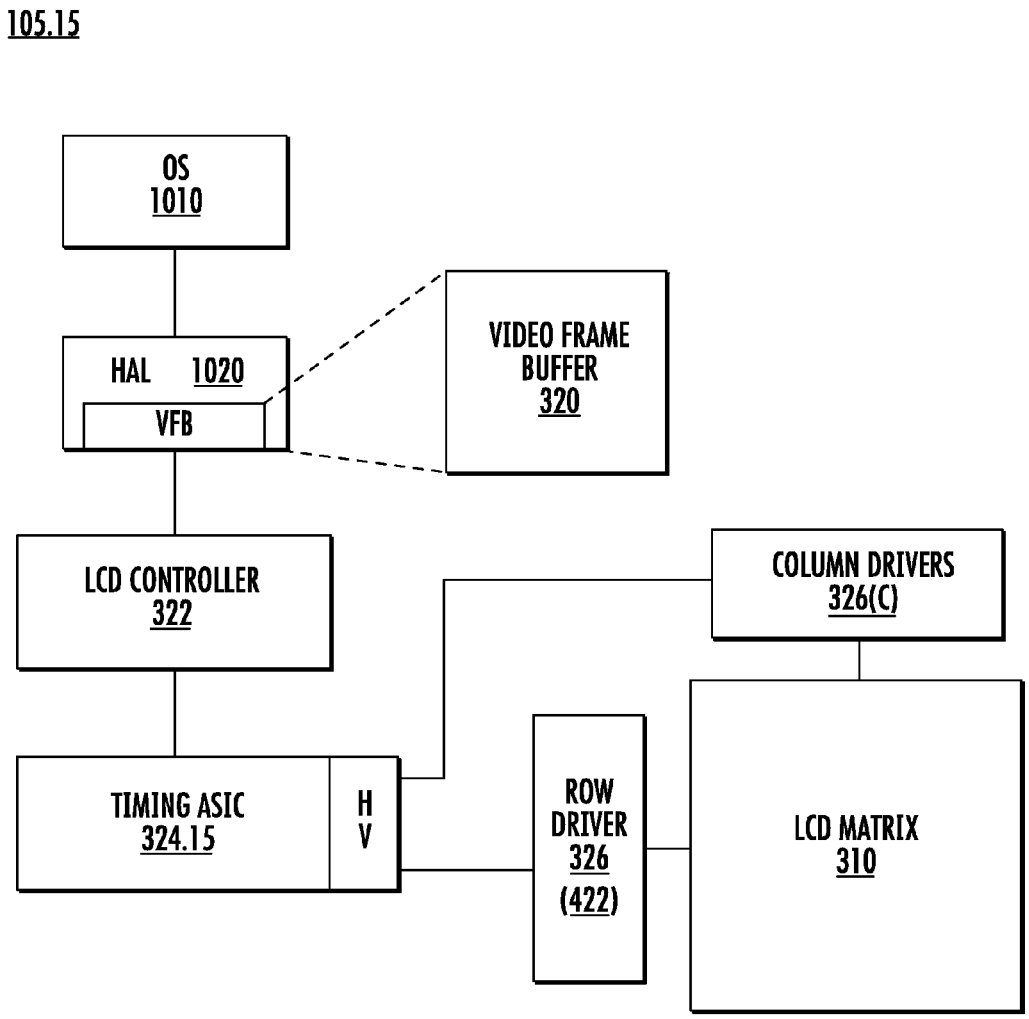
FIG. 15 is a logical block diagram of the display driver circuitry for controlling pixel border regions, in accordance with an embodiment of the present invention.

With reference now to FIG. 15, a logical diagram of the components of the novel display unit 105.15 in accordance with an embodiment of the present invention is depicted. An operating system (OS) 1010, resides in portions of a central processing unit (CPU) and memory of a host computer system (e.g., processor 101, ROM 103, and computer system 100; FIG. 3). In one implementation, OS 1010 is Palm OS™, a proprietary operating system of Palm, Inc., of Santa Clara, Calif., used extensively on PDAs. However, OS 1010 may be implemented on any computer operating system.

OS 1010 provides display control data to a hardware abstraction layer (HAL) 1020 whenever an application change is commanded, and/or whenever a display background color change is demanded. HAL 1020 functions as a translation stratum between the OS 1010 and various hardware components of the computer system; specifically, in the present implementation, the display functionality 315. In one embodiment, HAL 1020 also resides in portions of the CPU and memory. HAL 1020 translates display control commands, including border pixel control, originating in OS 1010 and writes them into its resident video frame buffer 320.

HAL 1020 transfers display control data, including control data for the border pixels, to LCD controller 322. LCD controller 1022 functions to control the information to be displayed on LCD matrix 310 accordingly. In one embodiment, LCD controller 322 exercises this control via a timing generator (e.g., timing generator 324; FIG. 8). In one implemetation, timing generator functions are effectuated by an application specific integrated circuit (ASIC) 324.15. ASIC 324.15 generates video synchronizing and other signals that control the LCD matrix 310 by triggering its row and column drivers 326(422) and 326(410)

In one embodiment, LCD controller 322 controls the display directly through row and column drivers 326(422) and 326(410). In the present embodiment, no ASIC or other timing generator is required. In another embodiment, LCD controller 322 controls the display by a combination of varying degrees of both direct control of the drivers under command of HAL 1020 and with ASIC 324.15 involvement.

Exemplary Single Memory Location Implementation

Figure 16A:
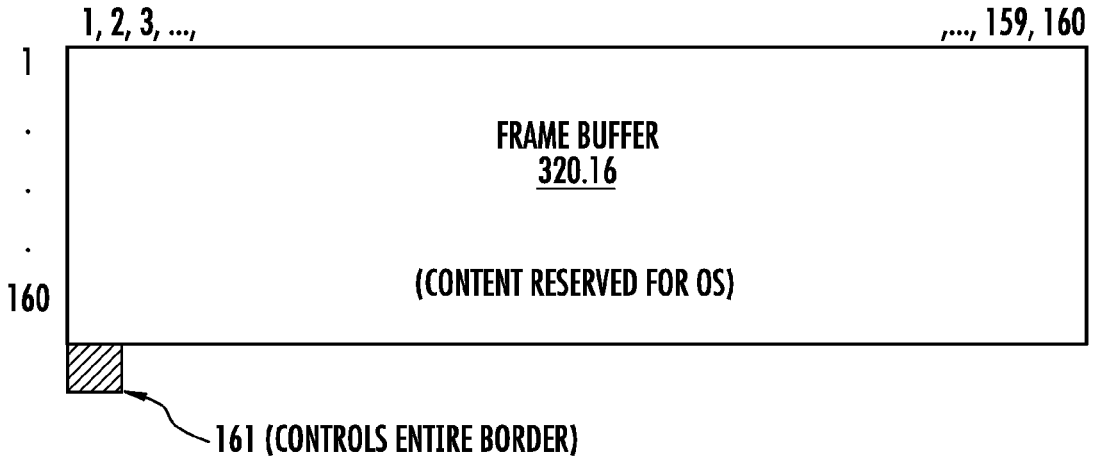
FIG. 16A depicts the structure of a frame buffer memory with a pixel for control of border pixel coloration, in accordance with an embodiment of the present invention.
Figure 16B:
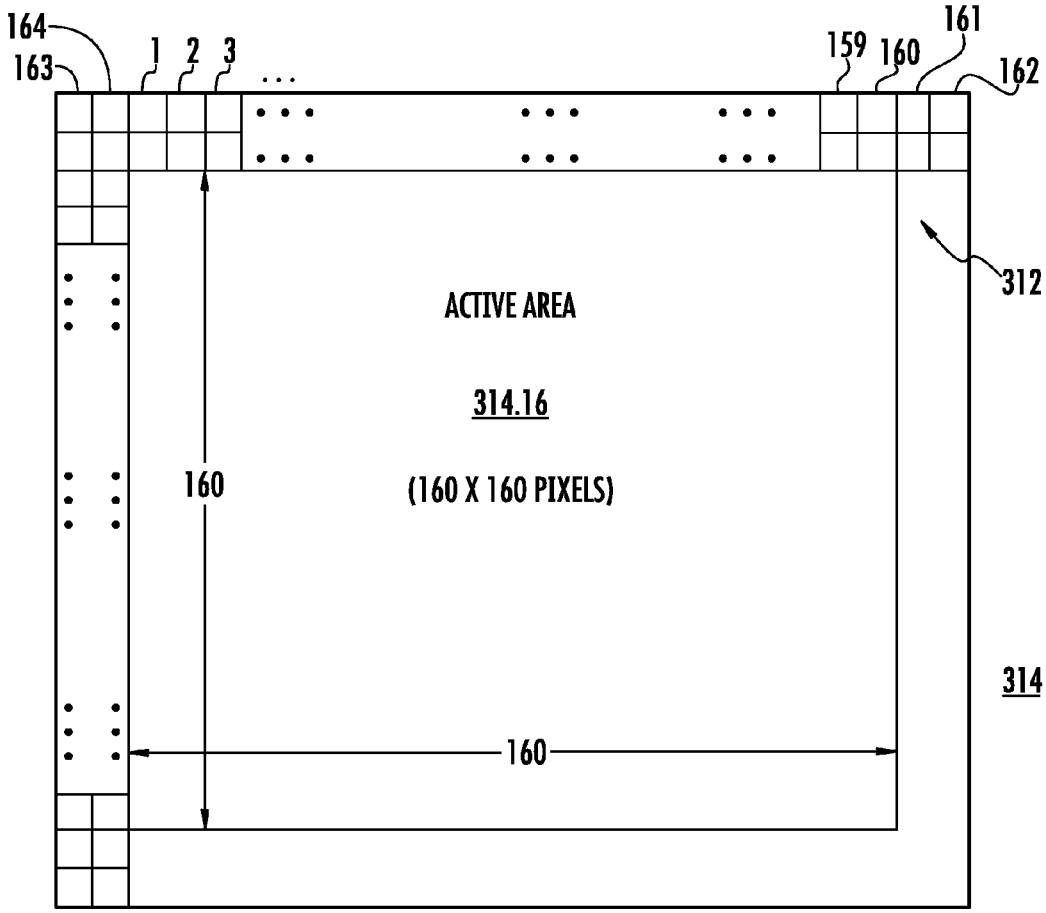
FIG. 16B depicts a display with an active region, and border pixels under control of a frame buffer pixel, in accordance with an embodiment of the present invention.

Referring now to FIGS. 16A and 16B, an exemplary implementation effectuating display control using a single extra memory location is depicted. Embodiments of the invention, including the present implementation, are applicable to a display of any area of pixels m×n. In the present implementation, a 160×161 pixel frame buffer 320.16 (FIG. 16A) uses 160×160 pixels of its content for control of the active area 314.16 of display 314 (FIG. 16B). These 160×160 pixels are pre-mapped frame buffer memory content, reserved exclusively for use by the OS (e.g., OS 1010; FIG. 15), mapped for OS control of active area 314.16 pixel content and corresponding informational display.

The actual memory capacity of frame buffer 320.16 is greater than m×n, e.g., in the present example, 160×160. A relatively large amount of memory content resides within frame buffer 320.16 and remains unused, unassigned, and unmapped. Such additional memory capacity within frame buffer 320.16 remains in memory locations therein unmapped, e.g., unassigned with respect to the OS control of active area display. Several embodiments of the present invention utilize one or more of these unmapped frame buffer memory locations to control the pixel border.

In the present embodiment, one unmapped, e.g., extra pixel 161 of memory content within frame buffer 320.16 (FIG. 16A) controls the color of the entire border 312 of display 314 (FIG. 16B). Border area 312 is constituted by a 2 pixel width along all edges of active area 314.16.

Pixel 161 constitutes a single memory location within the frame buffer 320.16, and effectively constitutes a 161×1 frame buffer memory locus. A HAL (e.g., HAL 1020; FIG. 15) periodically monitors this single 161×1 location, and determines a color for all of the pixels constituting the border region 312. Thus, in the present implementation, the pixels constituting border area 312 have a uniform color.

A timing generator, such as ASIC 324.15 (FIG. 15) is required for the transfer of the content of pixel 161 to the row and column drivers directly controlling the color of the pixels in the border area 312. In one embodiment, applications may write code to the HAL. HAL changes the content of frame buffer pixel 161 accordingly. Thus the color of border pixels 312 changes to correspond with the data written to pixel 161.

The present implementation utilizes memory capacity of existing frame buffers to achieve the control over the border pixel color, without requiring utilization of the 160×160 or other m×n content reserved for applications of the OS (e.g., OS 1010; FIG. 15). Advantageously, this renders the present implementation compatible with existing OS applications.

Exemplary 160 Memory Location Implementation

Figure 17A:
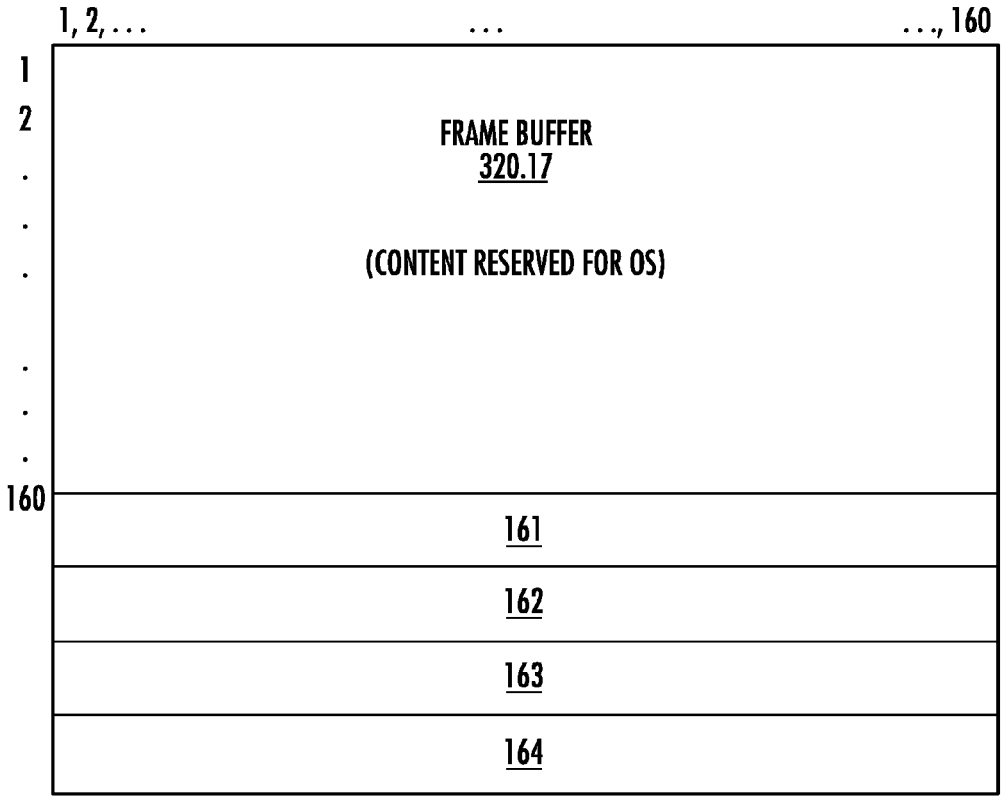
FIG. 17A depicts the structure of a frame buffer memory with a row of pixels for control of border pixel coloration, in accordance with an embodiment of the present invention.
Figure 17B:
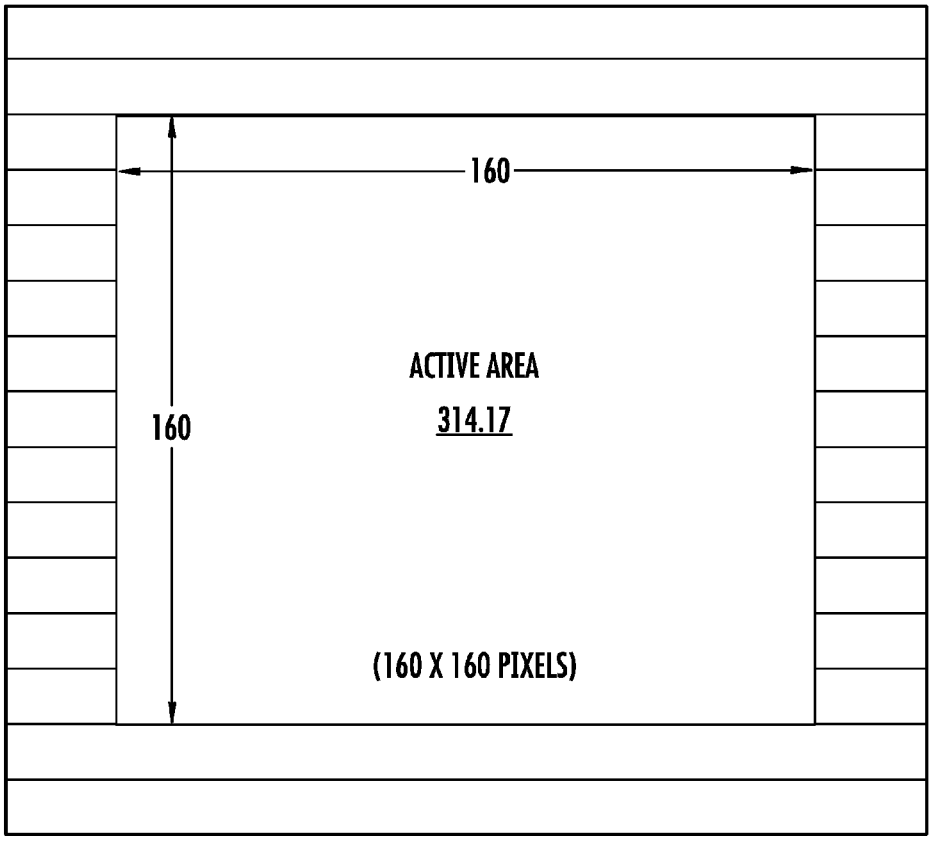
FIG. 17B depicts a display with an active region, and border pixels under control of a frame buffer pixel row, in accordance with an embodiment of the present invention.

With reference to FIGS. 17A and 17B, an exemplary implementation effectuating display control using 160 extra memory locations is depicted. Embodiments of the invention, including the present implementation, are applicable to a display of any area of pixels m×n. Effectively, the frame buffer 317.17 operates, in the present implementation, with an extra functional single-pixel wide, 160 pixel sequence row to control all of the border frame pixels 312. Thus, frame buffer 317.17 controls display 314 (FIG. 17B), including border pixels, with 161×1 by 161×160 pixels of its own capacity, e.g., utilizing 160 of its unmapped memory loci to control the border pixels 312. Importantly, in the present embodiment, display 314 is a liquid crystal module (LCM).

Pixel frame buffer 317.17 (FIG. 17A) uses its 160×160 pixel capacity reserved for the OS (e.g., OS 1010; FIG. 15) control over the display active area 314.17. Border area 312 is constituted by a 2 pixel width along all edges of active area 314.17. The color of all of the columns, including the columns in the border pixel area 312, are controlled directly by the frame buffer 317.17. Control over the color of the border pixels 312 is effectuated by the frame buffer column 161.

For example, each of the areas in video frame buffer 317.17 is mapped directly to the color of the columns constituting the pixel border area 312. The color of each constituent vertical line of the columns is replicated by a timing generator, such as ASIC 324.15 (FIG. 15), which is required for the transfer of the content of frame buffer column 161 to the row and column drivers directly controlling the color of the pixels in the border area 312. In one implementation, the color of each column would be uniform. In another embodiment, the color of each column may be variable.

Advantageously, the present implementation requires a less sophisticated timing generation mechanism than in the implementation discussed above (e.g., FIG. 16A, 16B). In as much as frame buffer 317.17 exercises a greater degree of direct control over border pixel color, an ASIC crafted to execute timing and replication of border pixel color may be simpler and correspondingly less expensive and demanding of power and computational resources (e.g., and/or correspondingly more functional in other useful aspects).

In the present implementation, with respect to the active area 314.17 (FIG. 17B), the region 161 of frame buffer 317.17 control is blanked out, e.g., acts as a "no care" area. This leaves control of the active display area 314.17 to the 160×160 region of frame buffer 317.17 dedicated, e.g., reserved to the OS (e.g., OS 1010; FIG. 15) control of the information display.

The ASIC or other timing generator function, with respect to controlling the border pixel color, is relatively simple. The ASIC or other timing generator merely replicates a full line, e.g., row, on the first two and last two rows of display 1700 (FIG. 17B). In the active area, only partial replication of the lines, e.g., rows, is effectuated, in as much as control over the visual information display, e.g., the active area 314.17, is left to the OS, via the 160×160 pixel region of frame buffer 317.17.

Exemplary 640 Memory Location Implementation

Figure 18A:
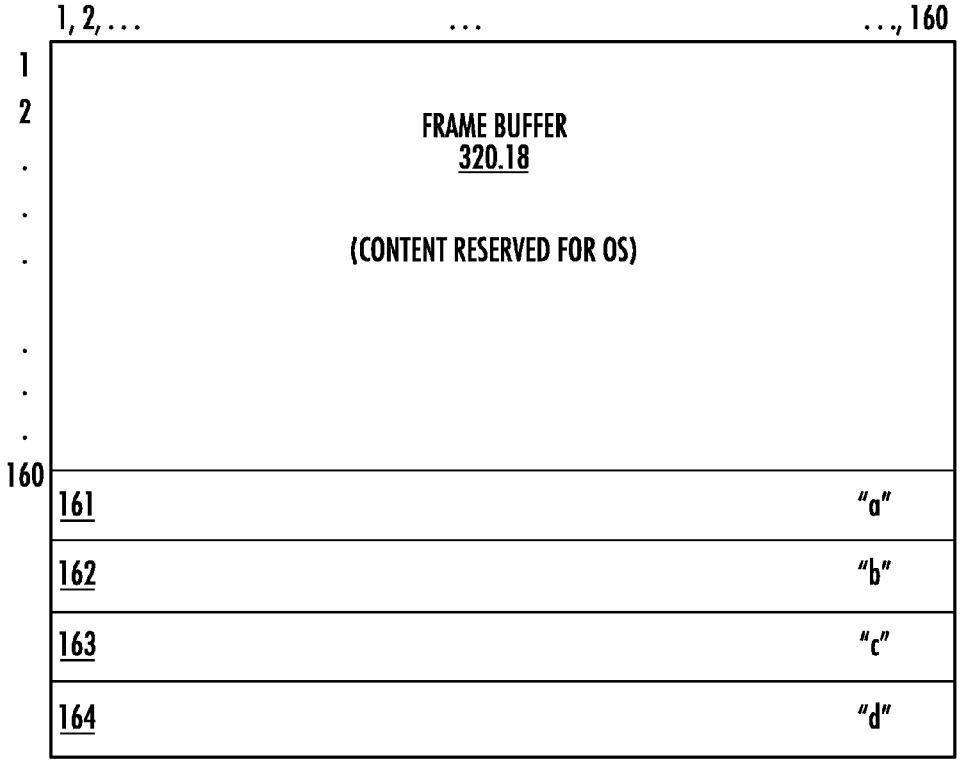
FIG. 18A depicts the structure of a frame buffer memory with several rows of pixels for control of border pixel coloration, in accordance with an embodiment of the present invention.
Figure 18B:
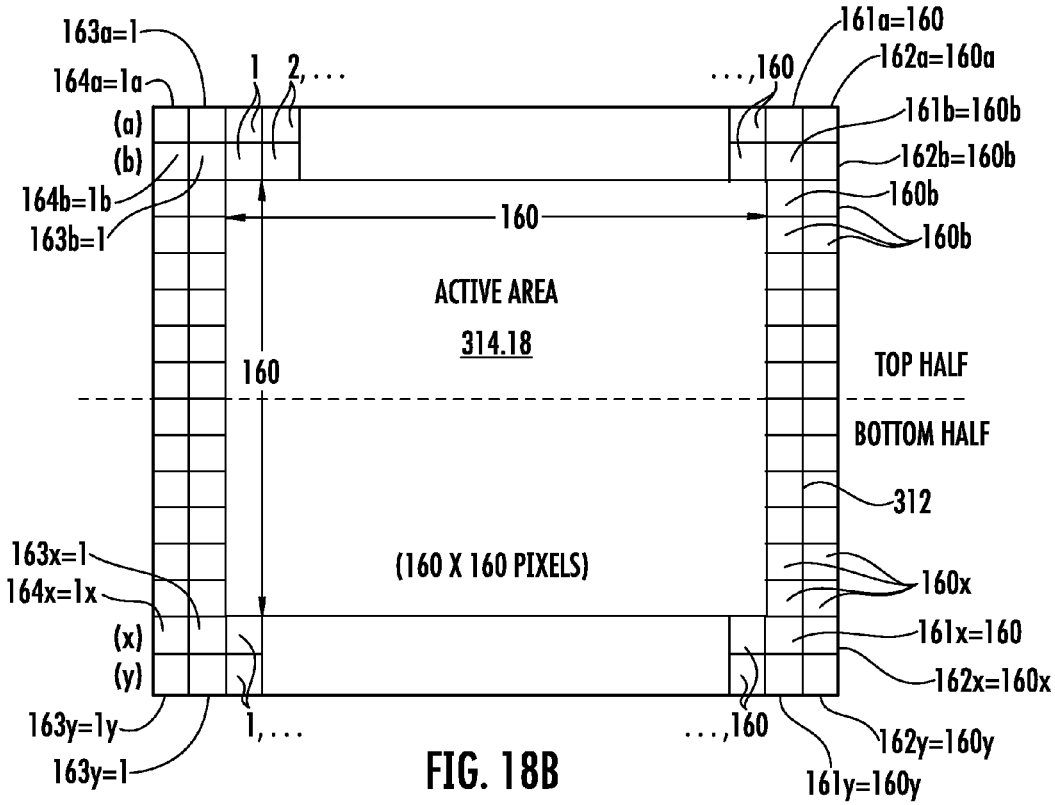
FIG. 18B depicts a display with an active region, and border pixels under control of a number of frame buffer pixel rows, in accordance with an embodiment of the present invention.

Now with reference to FIGS. 18A and 18B, an exemplary implementation effectuating display control using 640 extra memory locations is depicted. Embodiments of the invention, including the present implementation, are applicable to a display of any area of pixels m×n. In the present implementation, m×n is 160×160. Effectively, the frame buffer 317.18 operates, in the present implementation, with four (4) extra functional single-pixel wide, 160 pixel sequence rows to control all of the border frame pixels 312 on the display 314 (FIG. 18B). Thus, frame buffer 317.18 controls display 314, including border pixels, with 161×1 by 164×160 pixels of its own capacity, e.g., utilizing 640 of its unmapped memory loci to control the border pixels 312.

Importantly, in the present embodiment, display 314 is a liquid crystal module (LCM). Advantageously, the present implementation requires a less sophisticated timing generation mechanism than in either implementation discussed above (e.g., FIGS. 16A, 16B and 17A, 17B). In as much as frame buffer 317.18 exercises a greater degree of direct control over border pixel color, an ASIC (e.g., ASIC 324.15; FIG. 15) crafted to execute timing and replication of border pixel color may be simpler and correspondingly less expensive and demanding of power and computational resources (e.g., and/or correspondingly more functional in other useful aspects). The present implementation has further advantages, including obviating replication of horizontal lines to achieve control over border pixels. This also reduces the requisite ASIC complexity to control border pixels.

In the present implementation, a HAL (e.g., HAL 1020; FIG. 15), reads information contained in four (4) single pixel wide 160 pixels content rows within its frame buffer 320.18 and commands an LCD driver (e.g., LCD drivers 326(410), 326(420); FIG. 15) directly. The LCD driver controls the color of each pixel in the rows and columns 312 (FIG. 18B) constituting the border pixel area accordingly. In this way, the HAL effectively exercises direct control of each pixel in the border area, with very little replication. An LCD controller (e.g., LCD controller 322; FIG. 15) is pre-programmed to replicate only the four (4) single pixel wide 160 pixels content rows within its frame buffer 320.18; specifically frame buffer rows 161, 162, 163, and 164 (FIG. 18B). In the replication of these frame buffer 320.18 rows, horizontal border pixel rows are mapped peripherally to active area 314.18 in the following manner.

Active area 314.18 is depicted as having upper and lower halves. Memory locations across each horizontal row 161, 162, 163, and 164 in the frame buffer 320.18 replicate the color of vertical lines 1 through 160 constituting the vertical pixelation of active area 314.18 (FIG. 18B). The HAL (e.g., HAL 1020; FIG. 15), utilizing additional intelligence programmed therein, communicates to the LCD controller (e.g., LCD controller 322; FIG. 15) what color should be duplicated for frame buffer locations 161 through 164, in the border pixel area 312. Frame buffer locations 163 and 164 replicate the same colors as commanded in the active area, e.g., which is under the control of the OS (e.g., OS 1010; FIG. 15).

Thus, frame buffer locations 163 and 164 replicate, e.g., duplicate, in the border area 312 the pixel color found in column 1 of the active area 314.18. Correspondingly, frame buffer locations 161 and 162 replicate, e.g., duplicate, in the border area 312 the pixel color found in column 160 of the active area 314.18. ASIC (e.g., ASIC 324.15; FIG. 15) then replicates the same color vertically in the entire vertical border columns 163 and 164 to the left of active area 314.18, and in the entire vertical border columns 161 and 162 to the right of active area 314.18. Horizontal border pixel rows (a) and (b), and (x) and (y), respectively above and below active area 317.18, duplicate the color in the corresponding active area pixels 1 through 160, immediately adjacent to the border pixels in horizontal rows (b) and (x).

In one embodiment, duplication of the colors in border pixel area 312 is carried through each edge constituting a fourth of border pixel area 312; e.g., pixel 160*b* is duplicated and replicated down the entire right border of border pixel region 312 and pixel 1*b* is duplicated and replicated down the entire left border of border pixel region 312.

In one embodiment, the duplication is carried through only half of each edge constituting a fourth of border pixel area 312; e.g., pixel 160*b* is duplicated and replicated down the top half of the right border of border pixel region 312 and pixel 1*b* is duplicated and replicated down the top half of the left border of border pixel region 312. Correspondingly, in the present embodiment, pixel 160*x* is duplicated and replicated up the bottom half of the right border of border pixel region 312 and pixel 1*x* is duplicated and replicated up the bottom half of the left border of border pixel region 312. Other embodiments may utilize and/or combine any other permutations of this pixel replication and duplication scheme. For example, one embodiment applies replication and duplication of pixel 1*b* down the entire left side and replication and duplication of pixel 160*x* up the entire right side. In another embodiment, one edge utilizes duplication along the entire side, with the opposite edge utilizing duplication of halves, bottom-up and top-down.

The mapping of pixels in the border area 312 to the content of frame buffer 320.18 memory rows 161 through 163 requires a relatively sophisticated, complex coding. However, these coding requirements are met totally within the HAL, which in the present implementation bears adequate heretofore unused capacity to handle the corresponding coding burden. Advantageously, neither the timing ASIC or other timing generator nor the LCD drivers, are burdened by these mapping and coding tasks. Accordingly, within the present embodiment, the timing ASIC may be simpler, cheaper, less demanding of power and computational resources (e.g., and/or correspondingly more functional in other useful aspects).

Exemplary All-HAL Control Implementation

Figure 19:
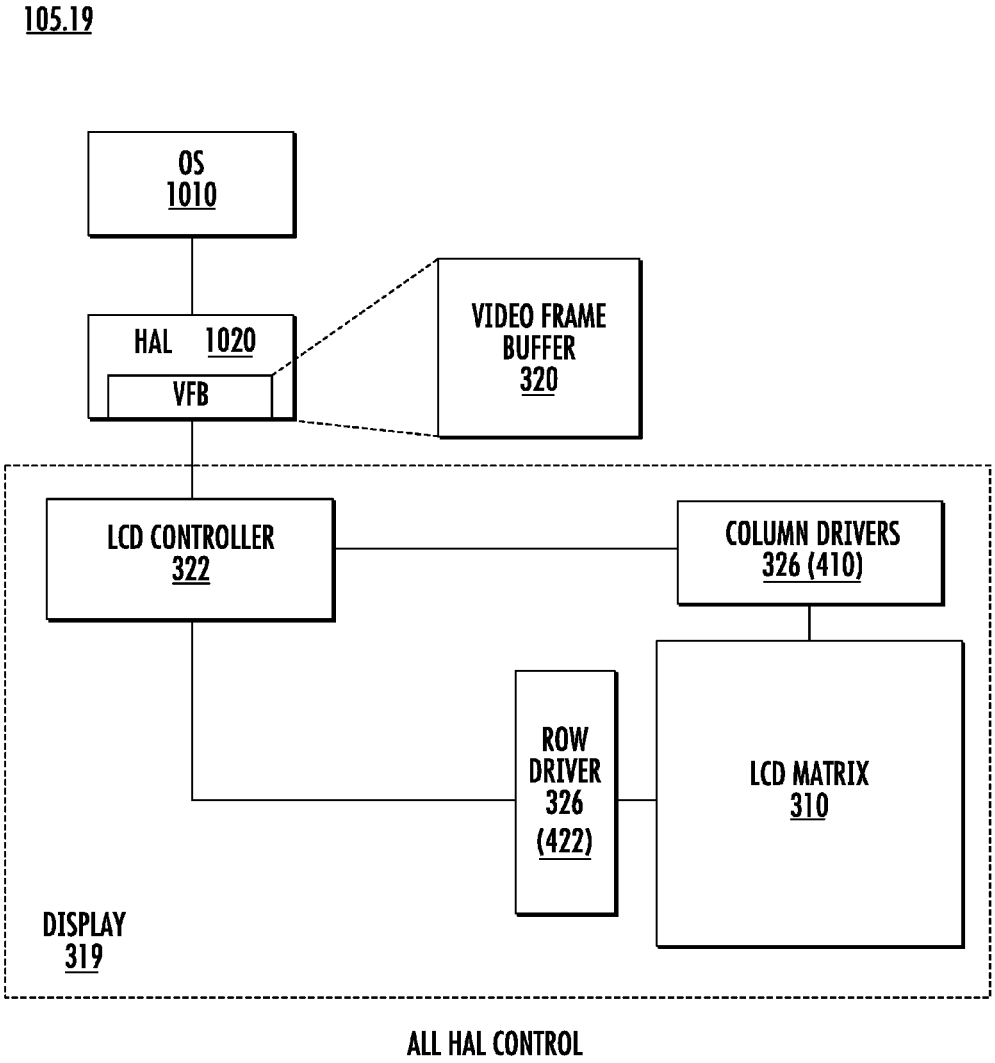
FIG. 19 is a logical block diagram of the display driver circuitry for controlling pixel border regions without a timing ASIC, in accordance with an embodiment of the present invention.
Figure 20A:
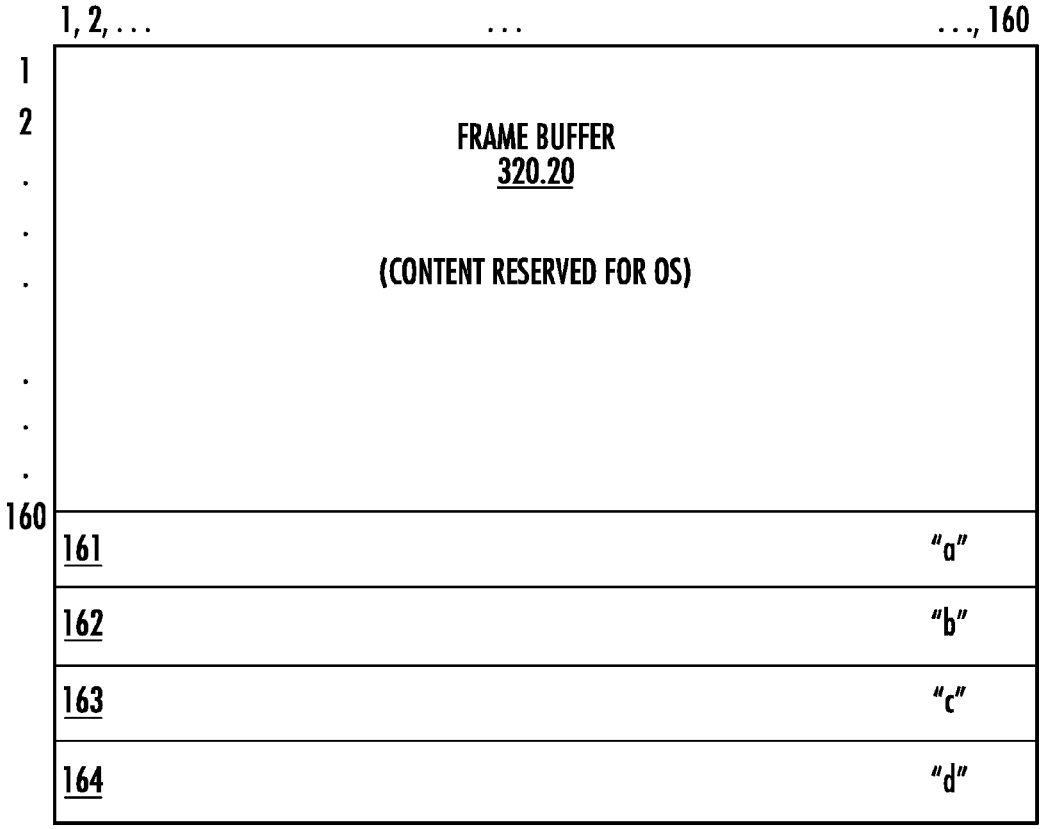
FIG. 20A depicts the structure of a frame buffer memory with several rows of pixels for control of border pixel coloration, in accordance with an embodiment of the present invention.
Figure 20B:
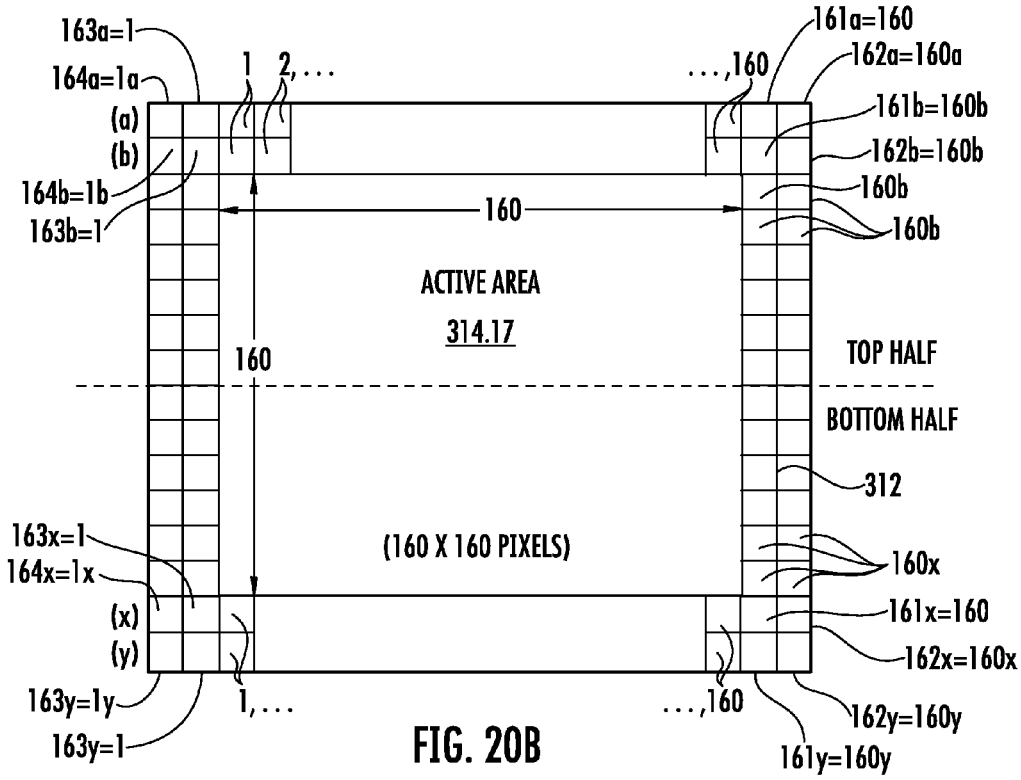
FIG. 20B depicts a display with an active region, and border pixels under direct control (including mapping) of a number of frame buffer pixel rows, without requiring a timing ASIC, in accordance with an embodiment of the present invention.

With reference to FIGS. 19, 20A, and 20B, an exemplary implementation effectuating display control applying total control via a HAL (e.g., HAL 1020; FIG. 15) is depicted. Embodiments of the invention, including the present implementation, are applicable to a display of any area of pixels m×n. In the present implementation, m×n is 160×160. Effectively, the frame buffer 317.20 operates, in the present implementation, with four (4) extra functional single-pixel wide, 160 pixel sequence rows to control all of the border frame pixels 312 on the display 314 (FIG. 20B). Thus, frame buffer 317.20 controls display 314, including border pixels, with 161×1 by 164×160 pixels of its own capacity, e.g., utilizing 640 of its unmapped memory loci to control the border pixels 312.

Importantly, in the present embodiment, control of each and every border pixel in border area 312 is effectuated through the HAL, via its frame buffer 320.20, with no timing ASIC or other timing generator necessary. Advantageously, dispensing with a timing ASIC or other timing generator increases both power and computational efficiency, and reduces unit costs. In the present embodiment, display 314 is a liquid crystal module (LCM).

With reference now to FIG. 19, a logical diagram of the components of the novel display unit 105.19 in accordance with an embodiment of the present invention is depicted. An operating system (OS) 1010, resides in portions of a central processing unit (CPU) and memory of a host computer system (e.g., processor 101, ROM 103, and computer system 100; FIG. 3). In one implementation, OS 1010 is Palm OS™, a proprietary operating system of Palm, Inc., of Santa Clara, Calif., used extensively on PDAs. However, OS 1010 may be implemented on any computer operating system.

OS 1010 provides display control data to a hardware abstraction layer (HAL) 1020 whenever an application change is commanded, and/or whenever a display background color change is demanded. HAL 1020 functions as a translation stratum between the OS 1010 and various hardware components of the computer system; specifically, in the present implementation, the display functionality 319. In one embodiment, HAL 1020 also resides in portions of the CPU and memory. HAL 1020 translates display control commands, including border pixel control, originating in OS 1010 and writes them into its resident video frame buffer 320.

HAL 1020 transfers display control data, including control data for the border pixels, to LCD controller 322. LCD controller 1022 functions to control the information to be displayed on LCD matrix 310 accordingly. HAL achieves this control by generating signals that control the LCD matrix 310 by triggering its row and column drivers 326(422) and 326 (410). In the present embodiment, LCD controller 322 controls the display directly through row and column drivers 326(422) and 326(410); no ASIC or other timing generator is required.

In the present implementation, HAL 1020 reads information contained in four (4) single pixel wide 160 pixels content rows within its frame buffer 320.20 and commands LCD drivers 326(410), 326(420) directly. The LCD driver controls the color of each pixel in the rows and columns 312 (FIG. 20B) constituting the border pixel area accordingly. In this way, the HAL 1020 effectively exercises direct control of each pixel in the border area, with very little replication. An LCD controller (e.g., LCD controller 322; FIG. 15) is preprogrammed to replicate only the four (4) single pixel wide 160 pixels content rows within its frame buffer 320.20; specifically frame buffer rows 161, 162, 163, and 164 (FIG. 20B). In the replication of these frame buffer 320.20 rows, horizontal border pixel rows are mapped peripherally to active area 314.20 in the following manner.

Active area 314.20 is depicted as having upper and lower halves. Memory locations across each horizontal row 161, 162, 163, and 164 in the frame buffer 320.20, unmapped with respect to the active area 314.20, replicate the color of vertical lines 1 through 160 constituting the vertical pixelation of active area 314.20 (FIG. 18B). The HAL (e.g., HAL 1020; FIG. 15), utilizing additional intelligence programmed therein, communicates to the LCD controllers 322 what color should be duplicated for frame buffer locations 161 through 164, in the border pixel area 312. Frame buffer locations 163 and 164 replicate the same colors as commanded in the active area, e.g., which is under the control of the OS 1010.

Thus, frame buffer locations 163 and 164 replicate, e.g., duplicate, in the border area 312 the pixel color found in column 1 of the active area 314.20. Correspondingly, frame buffer locations 161 and 162 replicate, e.g., duplicate, in the border area 312 the pixel color found in column 160 of the active area 314.20. HAL 1020 then replicates the same color vertically in the entire vertical border columns 163 and 164 to the left of active area 314.20, and in the entire vertical border columns 161 and 162 to the right of active area 314.20. Horizontal border pixel rows (a) and (b), and (x) and (y), respectively above and below active area 317.20, duplicate the color in the corresponding active area pixels 1 through 160, immediately adjacent to the border pixels in horizontal rows (b) and (x).

In one embodiment, duplication of the colors in border pixel area 312 is carried through each edge constituting a fourth of border pixel area 312; e.g., pixel 160*b* is duplicated and replicated down the entire right border of border pixel region 312 and pixel 1*b* is duplicated and replicated down the entire left border of border pixel region 312.

In one embodiment, the duplication is carried through only half of each edge constituting a fourth of border pixel area 312; e.g., pixel 160*b* is duplicated and replicated down the top half of the right border of border pixel region 312 and pixel 1*b* is duplicated and replicated down the top half of the left border of border pixel region 312. Correspondingly, in the present embodiment, pixel 160*x* is duplicated and replicated up the bottom half of the right border of border pixel region 312 and pixel 1*x* is duplicated and replicated up the bottom half of the left border of border pixel region 312. Other embodiments may utilize and/or combine any other permutations of this pixel replication and duplication scheme. For example, one embodiment applies replication and duplication of pixel 1*b* down the entire left side and replication and duplication of pixel 160*x* up the entire right side. In another embodiment, one edge utilizes duplication along the entire side, with the opposite edge utilizing duplication of halves, bottom-up and top-down.

The mapping of pixels in the border area 312 to the content of frame buffer 320.20 memory rows 161 through 163 requires a relatively sophisticated, complex coding. However, these coding requirements are met totally within the HAL 1020, which in the present implementation bears adequate heretofore unused capacity to handle the corresponding coding burden. Advantageously, the LCD controller 322 are not burdened in any way by these mapping and coding tasks. Accordingly, within the present embodiment, the HAL makes use of otherwise unused capacity, increasing the efficiency and economy of each unit.

Exemplary Method

Figure 21:
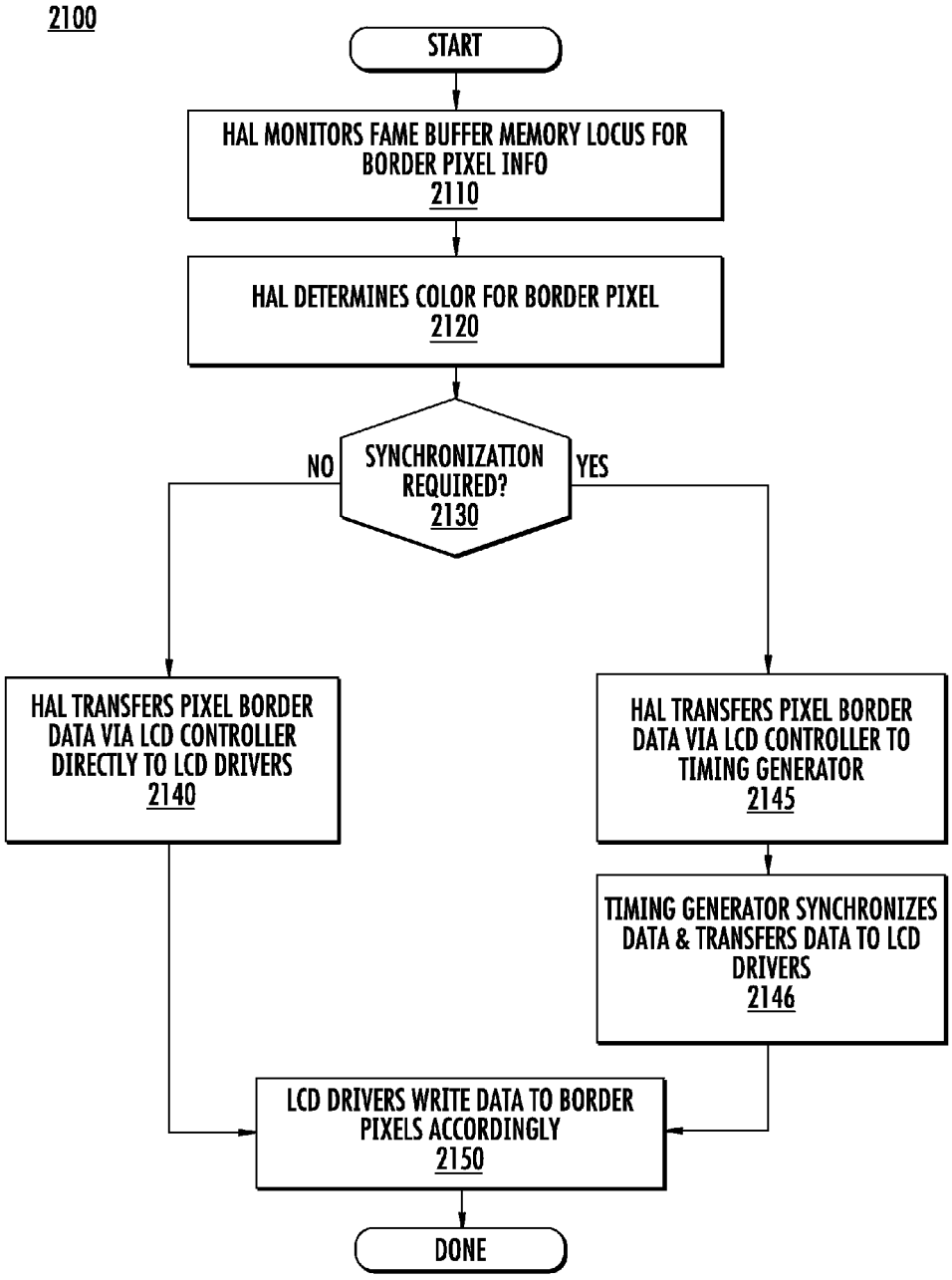
FIG. 21 is a flowchart of the steps in a process for achieving a controllable, variable color pixel border for a negative display mode display screen with a passive matrix drive, in accordance with an embodiment of the present invention.

Referring to FIG. 21, an exemplary process 2100 achieves a controllable, variable color pixel border for a negative display mode display screen with a passive matrix drive. Process 2100 may be effectuated by any of the aforementioned implementations above.

Beginning with step 2110, a HAL (e.g., HAL 1020; FIGS. 15, 19) monitors an frame buffer memory locus (e.g., frame buffer memory locus 161, FIG. 16A and frame buffer memory loci 161, 162, 163, 164; FIGS. 17A, 18A, 19A); unmapped with respect to the active pixel area (e.g., active area 314.16, 314.17, 314.18, 314.20; FIGS. 16, 17, 18, 20, respectively) for border pixel information stored therein.

In step 2120, the HAL determines a color for pixels constituting the border (e.g., border pixels 312; FIGS. 16B, 17B, 18B, 19B) surrounding an active screen area (e.g., active area 314.16, 314.16, 314.17, 314.18; FIGS. 16B, 17B, 18B, 19B), itself under the control under the exclusive control of an OS (e.g., OS 1010; FIGS. 15, 19). The HAL generates a pixel border color signal corresponding to the color determined for the border pixels.

In step 2130, it is determined whether the HAL will require external synchronization to transfer border pixel data for display upon the pixels constituting the border, or whether the HAL will perform such synchronization internally.

If it is determined (step 2130) that no such synchronization external to the HAL is required, e.g., wherein the HAL performs any required synchronization internally, process 2100 proceeds via step 2140, wherein the HAL transfers border pixel data, in the form of the border pixel color signal, via an LCD controller (e.g., LCD controller 322; FIG. 19) directly to LCD drivers (e.g., LCD drivers 326(410), 326(422); FIG. 19).

If it is determined (step 2130) that synchronization external to the HAL is required, process 2100 proceeds via step 2145, wherein the HAL transfers border pixel data, in the form of the border pixel color signal, via an LCD controller (e.g., LCD controller 322; FIG. 19) to a timing generator, such as a timing ASIC (e.g., ASIC 324.15; FIG. 15).

The ASIC or other timing generator synchronizes the data with the visual information formatted by the OS (e.g., for control of the active area information display), generates a corresponding border pixel color writing signal, and transfers the data, in the form of the border pixel color writing signal, to the LCD drivers; step 2146.

In the event that the HAL performed any requisite synchronization internally, the border pixel color writing signal is generated by the LCD controller in response to the HAL transferring a border pixel color signal to the LCD controller (step 2140).

Whether the border pixel color writing signal is generated by the LCD driver in direct response to the HAL transferring a border pixel color signal (step 2140), or whether the border pixel color writing signal is generated by the ASIC or other timing mechanism, external to the HAL (step 2146), the LCD drivers are impelled by the border pixel color writing signal to write color data to the border pixels (e.g., border pixels 312; FIGS. 16B, 17B, 18B, 19B) accordingly; step 2150. Process 2100 is complete at this point.

In summary, a display unit is constituted in one embodiment herein by a passive matrix of independently controllable pixels characterized by an active area of n rows and m columns of discrete pixels and a pixel border. In one embodiment, m and n are both 160. The passive matrix is operable to generate an image in response to electronic signals driven from row and column drivers coupled to it, representative of information stored in a frame buffer memory. The pixel border has a predetermined width, and surrounds the passive matrix active area. In one embodiment, the predetermined width is two pixels. The border pixel color state is controlled herein by the frame buffer memory. The pixel border color state is controlled to correspond to information contained in a locus of the frame buffer memory. This locus may be, in various embodiments herein, a single pixel, a row of pixels, or a number of rows of pixels of frame buffer memory. Each row of pixels may be equal to m and/or n, and may be 160. In one embodiment, the frame buffer controls the border pixels directly via a liquid crystal display controller and drivers, without a timing generation mechanism, such as a timing ASIC. In one embodiment, the display unit constitutes a part of a portable electronic device.

In one embodiment, a method of controlling the color of the border pixels constitutes a process including monitoring a locus within the frame buffer memory for information, determining a color for the border pixels corresponding thereto, generating a pixel border color signal corresponding to the color, transferring the pixel border color signal to the liquid crystal display controller, which generates a pixel border color writing signal and impels the drivers to write a color to the border pixels accordingly. The hardware abstraction layer monitors the frame buffer memory locus, determines the border pixel color, and generates the pixel border color signal. In one embodiment, impelling the drivers to write a color to the pixel border does not involve a timing synchronization mechanism external from the hardware abstraction layer.

The preferred embodiment of the present invention, an apparatus and method for achieving a controllable, variable color pixel border for a negative display mode display screen with a passive matrix drive, is thus described. While the present invention has been described in particular embodiments, it should be appreciated that the present invention should not be construed as limited by such embodiments, but rather construed according to the below claims.

What is claimed is:

1. A display unit comprising:

a display matrix of independently controllable pixels comprising n rows and m columns of discrete pixels, said display matrix to generate an image in response to electronic signals driven from row and column drivers coupled thereto, said image representative of information stored in a frame buffer memory; and a pixel border surrounding said display matrix and comprising a plurality of pixels which are controlled to a color state by one or more unmapped locations of said frame buffer memory, said unmapped memory locations control said plurality of pixels directly via a liquid crystal display controller and drivers, without a timing generation mechanism.

2. A display unit as described in claim 1, said color state of said pixel border to correspond to information within a locus of said frame buffer, said locus comprising one or more unmapped memory locations within said frame buffer memory.

3. A display unit as described in claim 2, said locus of said frame buffer comprising a single pixel of memory within said frame buffer.

4. A display unit as described in claim 2, said locus of said frame buffer comprising a row of pixels of memory within said frame buffer.

5. A display unit as described in claim 4, said row of pixels of memory within said frame buffer comprising n pixels of memory within said frame buffer.

6. A display unit as described in claim 2, said locus of said frame buffer comprising a plurality of rows of pixels of memory within said frame buffer.

7. A display unit as described in claim 6, each said row of pixels of memory within said frame buffer comprising n pixels of memory within said frame buffer, each said row mapping to a corresponding portion of said plurality of pixels comprising said pixel border.

8. A display unit as described in claim 1, said passive matrix comprising negative display mode liquid crystal display technology.

9. A display unit as described in claim 8, said liquid crystal display technology comprising super-twisted nematic.

10. A display unit as described in claim 1, said predetermined width comprising two pixels.

11. A display unit as described in claim 1, said passive matrix comprising 160 rows and 160 columns of discrete pixels.

12. A portable electronic device comprising:

a processor coupled with a bus;

a memory unit coupled with said bus;

a user input device coupled with said bus; and a display unit coupled with said bus and comprising:

a display matrix of independently controllable pixels comprising n rows and m columns of discrete pixels, said display matrix to generate an image in response to electronic signals driven from row and column drivers coupled thereto, said image representative of information stored in a frame buffer memory; and a pixel border surrounding said display matrix and comprising a plurality of pixels which are controlled to a color state by one or more unmapped locations of said frame buffer memory, said unmapped memory locations control said plurality of pixels directly via a liquid crystal display controller and drivers, without a timing generation mechanism.

13. A portable electronic device as described in claim 12, said color state of said pixel border to correspond to information within a locus of said frame buffer, said locus comprising one or more unmapped memory locations within said frame buffer memory.

14. A portable electronic device as described in claim 13, said locus of said frame buffer comprising a single pixel of memory within said frame buffer.

15. A portable electronic device as described in claim 13, said locus of said frame buffer comprising a row of pixels of memory within said frame buffer.

16. A portable electronic device as described in claim 15, said row of pixels of memory within said frame buffer comprising n pixels of memory within said frame buffer.

17. A portable electronic device as described in claim 13, said locus of said frame buffer comprising a plurality of rows of pixels of memory within said frame buffer.

18. A portable electronic device as described in claim 17, each said row of pixels of memory within said frame buffer comprising n pixels of memory within said frame buffer, each said row mapping to a corresponding portion of said plurality of pixels comprising said pixel border.

19. A portable electronic device as described in claim 12, said passive matrix comprising negative display mode liquid crystal display technology.

20. A display unit as described in claim 19, said liquid crystal display technology comprising super-twisted nematic.

21. A display unit as described in claim 12, said predetermined width comprising two pixels.

22. A display unit as described in claim 12, said passive matrix comprising 160 rows and 160 columns of discrete pixels.

23. In an electronic system comprising a hardware application layer with a frame buffer memory, and a negative display mode liquid crystal display with a passive matrix drive comprising a liquid crystal display controller, drivers, and a liquid crystal display matrix with an active pixel area and a pixel border, a method of controlling the color of said pixel border comprising:

monitoring a locus within said frame buffer memory for information;

determining a color for said pixel border corresponding to said information;

generating a pixel border color signal corresponding to said color;

transferring said pixel border color signal to said liquid crystal display controller;

generating a pixel border color writing signal corresponding to said pixel border color signal; and impelling said drivers, without a timing generation mechanism, to write a color to said pixel border.

24. The method as recited in claim 23, wherein:

said monitoring a locus within said frame buffer memory for information, said determining a color for said pixel border corresponding to said information, and said generating a pixel border color signal corresponding to said color are performed by said hardware abstraction layer.

* * * * *